US008499742B2

(12) United States Patent
Cho et al.

(10) Patent No.: US 8,499,742 B2
(45) Date of Patent: Aug. 6, 2013

(54) VALVE TRAIN OF INTERNAL COMBUSTION ENGINE

(75) Inventors: Masaki Cho, Saitama (JP); Tadashi Niino, Saitama (JP); Toshiyuki Sato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 609 days.

(21) Appl. No.: 12/831,320

(22) Filed: Jul. 7, 2010

(65) Prior Publication Data

US 2011/0023803 A1 Feb. 3, 2011

(30) Foreign Application Priority Data

Jul. 31, 2009 (JP) ..... 2009-179496

(51) Int. Cl.
*F01L 1/34* (2006.01)
*F02D 13/02* (2006.01)

(52) U.S. Cl.
USPC ..... 123/345; 123/90.17; 123/90.6; 123/347

(58) Field of Classification Search
USPC ..... 123/90.15–90.18, 90.27, 90.31, 90.6, 123/345–348; 74/567, 568
See application file for complete search history.

(56) References Cited

U.S. PATENT DOCUMENTS

| | | | | |
|---|---|---|---|---|
| 5,592,906 | A * | 1/1997 | Kreuter et al. | 123/90.16 |
| 7,096,837 | B2 * | 8/2006 | Kieninger et al. | 123/90.16 |
| 7,213,552 | B1 * | 5/2007 | Griffiths | 123/90.16 |
| 8,375,905 | B2 * | 2/2013 | Sato et al. | 123/90.16 |
| 2009/0199804 | A1 * | 8/2009 | Hendriksma | 123/90.55 |
| 2009/0241873 | A1 * | 10/2009 | Muraoka et al. | 123/90.15 |

FOREIGN PATENT DOCUMENTS

JP 2005-233180 A 9/2005

* cited by examiner

*Primary Examiner* — Willis R Wolfe, Jr.
(74) *Attorney, Agent, or Firm* — Birch, Stewart, Kolasch & Birch, LLP

(57) ABSTRACT

A valve train of an internal combustion engine having a swing of a link mechanism that is stabilized to stabilize the operating characteristics of an engine valve. A camshaft is provided together with a valve operating cam pivotally supported by the camshaft so as to operatively open and close an engine valve. A link mechanism allows a drive cam rotated integrally with the camshaft to swing the valve operating cam, and a drive mechanism swings the link mechanism, wherein opening and closing of the engine valve are started in a buffer section of the valve operating cam, and opening/closing timing of the engine valve is controlled by the drive mechanism swinging the valve operating cam via the link mechanism, without the provision of a buffer transition section and a buffer constant-speed section encountered at the time of transiting from a base circle to a cam lobe of the drive cam.

20 Claims, 12 Drawing Sheets

VALVE TRAIN OF INTERNAL COMBUSTION ENGINE

CROSS-REFERENCE TO RELATED APPLICATIONS

The present application claims priority under 35 USC 119 to Japanese Patent Application No. 2009-179496 filed on Jul. 31, 2009 the entire contents of which are hereby incorporated by reference.

BACKGROUND OF THE INVENTION

1. Field of the Invention

The present invention relates to a valve train of an internal combustion engine that includes a valve operating cam for opening and closing engine valves and a drive cam for driving the valve operating cam for controlling the timing of the opening and the closing of the engine valves.

2. Description of Background Art

A valve train for an internal combustion engine is known as described below. The valve train includes a drive cam rotated integrally with a camshaft supported by a cylinder head and a valve operating cam swingably supported by the camshaft to open and close the engine valves. In addition, the valve train includes a link mechanism supported swingably around the camshaft to transmit a valve driving force of the drive cam to the valve operating cam for swing and a drive mechanism for swinging the link mechanism around the camshaft. The valve train configured as above can vary the operative characteristics of the engine valves depending on the swinging position of the swung link mechanism. See, for example, Japanese Patent Laid-open No. 2005-233180.

In the traditional valve train described above, a sub-rocker arm constituting the link mechanism is lifted and swung by the drive cam. The drive cam is provided with a base circular portion adapted not to swing the sub-rocker arm and a cam lobe portion adapted to swing the sub-rocker arm as well as with a buffer portion at a section transiting from a base circle to a cam lobe. FIG. 12 is a graph showing the operating characteristics of the traditional drive cam. The traditional buffer portion S is described with reference to FIG. 12.

In general, the base circular portion and the cam lobe portion are not smoothly joined to each other. In the drive cam of FIG. 12, the buffer portion S includes a buffer transition section Sa where lift speed is increased along with the rotation of a camshaft and a buffer constant-speed section Sb being continuous with the buffer transition section Sa and providing constant lift speed. An acceleration section Sc adapted to increase the lift speed at high acceleration is provided continuously with the buffer constant-speed section Sb.

Since the buffer transition section Sa provides relatively high lift acceleration, it is probable that the sub-rocker arm is elastically deformed and allowed by the buffer transition section Sa to jump slightly. Also if the sufficient length of the buffer constant-speed portion Sb cannot be ensured, the behavior of the sub-rocker arm probably may become unstable.

Further, if the buffer transition section Sa and the buffer constant-speed section Sb are provided, the section of the acceleration section Sc adapted to increase the swing speed of the sub-rocker arm cannot be lengthened according to such a provision. Therefore, the acceleration of the sub-rocker arm is increased at the acceleration section Sc. More particularly during the high-rotation of the internal combustion engine, the elastic deformation of the sub-rocker arm may be increased and the jumping of the sub-rocker arm may occur.

Thus, the swing amount of the sub-rocker arm varies, which probably influences the operating characteristics of the engine valve.

SUMMARY AND OBJECTS OF THE INVENTION

The present invention has been made in view of the situations described above and aims to provide a valve train of an internal combustion engine that can stabilize the swing of a link mechanism to stabilize the operating characteristics of an engine valve.

To solve the above-mentioned problem, an embodiment of the present invention includes, in a valve train of an internal combustion engine, a camshaft rotated in conjunction with a crankshaft of the internal combustion engine with a valve operating cam pivotally supported by the camshaft so as to operatively open and close an engine valve as an intake valve or an exhaust valve. A link mechanism is provided for allowing a drive cam rotated integrally with the camshaft to swing the valve operating cam around the camshaft with a drive mechanism for swinging the link mechanism around the camshaft. The opening and closing of the engine valve are started in a buffer section of the valve operating cam, and opening/closing timing of the engine valve is controlled by the drive mechanism swinging the valve operating cam around the camshaft via the link mechanism without the provision of a buffer transition section and a buffer constant-speed section encountered at the time of transiting from a base circle to a cam lobe of the drive cam. An acceleration section is provided wherein lift speed of the drive cam is increased and a constant-speed section subsequent thereto wherein the lift speed of the drive cam is constant are provided in place of the buffer transition section and the buffer constant-speed section. The constant-speed section is provided to extend over an angle width including at least a maximum retard angle position of opening timing of the engine valve.

With this configuration, the acceleration section adapted to increase the lift speed is provided without the provision of the buffer transiting portion and the buffer constant-speed portion on the drive cam. Therefore, the section where the drive cam accelerates the swing of the link mechanism can be lengthened according to without the provision of the buffer transiting portion and the buffer constant-speed section. In this way, the link mechanism can gently be accelerated to thereby suppress the elastic deformation of the link mechanism resulting from the application of high acceleration of swing thereto. Thus, the swing of the link mechanism can be stabilized to stabilize the operating characteristics of the engine valve.

In addition, the constant-speed section where the lift speed of the drive cam is constant is provided to extend over the angle width including at least the most retard angle position of the opening timing of the engine valve. Therefore, the lift speed of the section on the advance angle side of the most retard angle position can be made as the speed of the constant-speed section. In this way, the lift speed of the drive cam corresponding to the most retard angle position of the opening timing and to the opening timing on the advance angle side of the most retard angle position can be made as the speed of the constant-speed section regardless of the opening/closing timing. In addition, the swing speed of the valve operating cam opening and closing the engine valve can be made constant. Thus, it is possible to prevent the striking sound of the engine valve occurring due to the variation of the opening/closing timing.

In the configuration described above, a start point of the acceleration section may be in a free running area where lift of the engine valve is not involved although the valve-operating cam is swung, the free running area being provided on a base circle of the valve-operating cam.

In this case, the free running area not involving the lift of the engine valve and provided on the base circle of the valve operating cam is increased to thereby make it possible to ensure the large length of the acceleration section of the drive cam, reducing the acceleration applied to the link mechanism. The acceleration of the drive cam at the start point of the acceleration section does not influence the lift operation of the engine valve; therefore, the operating characteristics of the engine valve can be stabilized.

A terminal end of the acceleration section may be located in front of or in a buffer-portion area of the valve operating cam.

In this case, since the terminal end of the acceleration section is provided in front of or in the buffer area of the valve operating cam, the long acceleration section can be ensured to reduce acceleration applied to the link mechanism. Further, since the terminal end of the acceleration section has almost the same speed as that of the constant-speed section, even if the terminal end of the acceleration section is provided in the buffer section of the lift of the engine valve, there is no difference in the situations of occurrence of the striking sound between the advance angle time and the retard angle time. Thus, the operating characteristics of the engine valve can be stabilized.

Further, the terminal end of the acceleration section may be in the buffer-portion area of the valve-operating cam in a maximum valve characteristic and in front of the buffer-portion area of the valve-operating cam in a minimum valve characteristic and the buffer-portion area of the valve-operating cam may be in an area of the constant-speed section.

In this case, the engine valve is opened and closed by the valve operating cam swung at the same swing angle speed by the constant-speed section; therefore, the striking sound at the time of valve-opening can be reduced. In the maximum valve characteristic, the buffer-portion area of the valve operating cam is not in the constant-speed section. However, since the swing angle speed does not vary so much, the acceleration section can be increased to minimize the elastic deformation of the link mechanism.

A deceleration section extending from a terminal end of the constant-speed section to the base circle of the drive cam may be provided and the acceleration section may be provided so that a start point of the acceleration section coincides with a terminal end of the deceleration section.

In this case, the length of the acceleration section can be maximized to minimize the elastic deformation of the link mechanism.

In the valve train of an internal combustion engine according to the present invention, the acceleration section of the drive cam can be lengthened according to without the provision of the buffer transition section and the buffer constant-speed section. Therefore, the swing of the link mechanism can gently be accelerated. In this way, the elastic deformation of the link mechanism resulting from the application of a high acceleration of swing thereto can be suppressed. Thus, the swing of the link mechanism can be stabilized to stabilize the operating characteristics of the engine valve.

The constant-speed section of the drive cam is provided to extend over the angle width including at least the maximum retard angle position of the opening timing of the engine valve. Therefore, the lift speed of the section on the advance angle side of the most retard angle position can be made as the speed of the constant-speed section. In this way, the lift speed of the drive cam corresponding to the most retard angle position and to the advance angle side of the most retard angle position can be made as the speed of the constant-speed section regardless of the opening/closing timing. In addition, the swing speed of the valve operating cam opening and closing the engine valve can be made constant. Thus, it is possible to prevent the striking sound of the engine valve occurring due to the variation of the opening/closing timing.

The free running area not involving the lift of the engine and provided on the base circle of the valve operating cam is increased. Therefore, the large length of the acceleration section of the drive cam can be ensured to reduce the acceleration applied to the link mechanism. Since the acceleration does not influence the lift operation of the engine valve, the operating characteristics of the engine valve can be stabilized.

The terminal end of the acceleration section is provided in front of or in the buffer-portion area of the valve operating cam. Therefore, the long acceleration section can be ensured to reduce the acceleration applied to the link mechanism. Further, the terminal end of the acceleration section has almost the same speed as that of the constant-speed section. Therefore, even if the terminal end of the acceleration section is provided in the buffer section of the valve lift, there is no difference in the situations of occurrence of the striking sound between the advance angle time and the retard angle time. Thus, the operating characteristics of the engine valve can be stabilized.

Further, the engine valve is opened and closed by the valve operating cam swung by the constant-speed section at the same swing angle speed; therefore, the striking sound at the time of valve-closing can be reduced. The buffer-portion area of the valve operating cam is not in the constant-speed section in the maximum valve characteristic. However, the swing angle speed does not vary so much; therefore, the acceleration section is increased to minimize the elastic deformation of the link mechanism.

In addition, the length of the acceleration section can be maximized to minimize the elastic deformation of the link mechanism.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will hereinafter be described with reference to the drawings. It is to be noted that orientations such as the front, back or rear, left and right, and upside and downside in the explanation shall be described based on a vehicle body.

Figure 1:
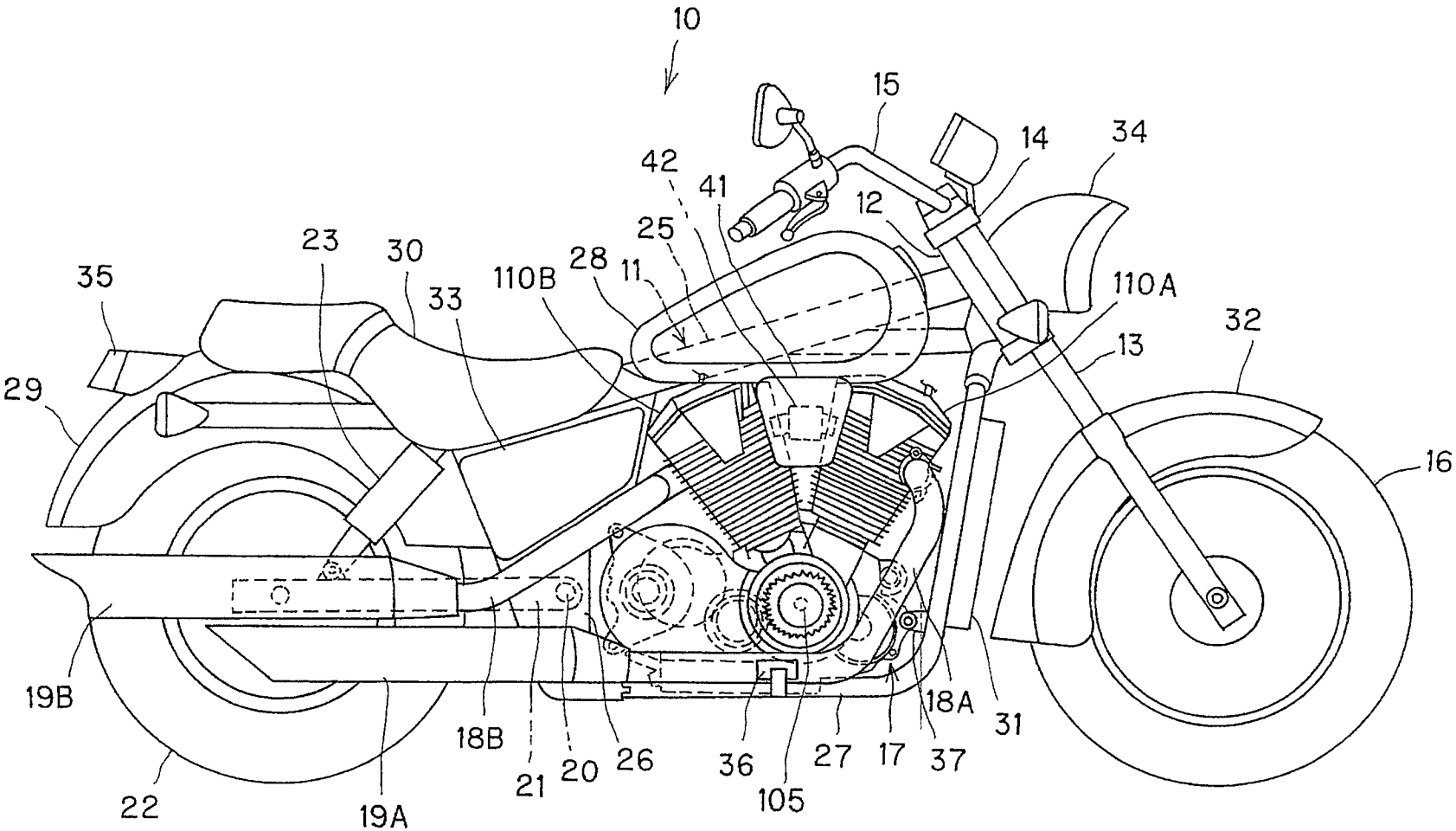
FIG. 1 is a lateral view of a cruiser type motorcycle according to an embodiment of the present invention.

FIG. 1 is a lateral view of a motorcycle employing a valve train according to an embodiment of the present invention. The motorcycle 10 includes a body frame 11; a pair of left and right front forks 13 turnably supported by a head pipe 12 attached to a front end of the body frame 11; a steering handlebar 15 attached to a top bridge 14 supporting an upper end of the front forks 13; and a front wheel 16 rotatably supported by the front fork 13. The motorcycle 10 further includes an engine 17 as an internal combustion engine supported by the body frame 11; exhaust mufflers 19A and 19B connected via exhaust pipes 18A and 18B, respectively, to the engine 17; a rear swing arm 21 supported swingably up and down by a pivot 20 at a rear lower portion of the body frame 11; and a rear wheel 22 rotatably supported by a rear end of the rear swing arm 21. A rear shock absorber 23 is disposed between the rear swing arm 21 and the body frame 11.

The body frame 11 includes a main frame 25 extending rearward downward from the head pipe 12, a pair of left and right pivot plates (also called center frames) connected to a rear portion of the main frame 25, and a down tube 27 extending downward from the head pipe 12, then bending and extending, and connected to the pivot plate 26. A fuel tank 28 is supported by the main frame 25 so as to straddle the main frame 25. A rear portion of the main frame 25 extends to above the rear wheel 22 and supports a rear fender 29. A seat 30 is supported between above the rear fender 29 and the fuel tank 28. In addition, in FIG. 1, a radiator 31 is supported by the down tube 27, with a front fender 32, a side cover 33, a headlight 34, a taillight 35, and an occupant step 36.

The engine 17 is supported in a space surrounded by the main frame 25, the pivot plate 26 and the down tube 27. The engine 17 is a fore-aft V-type 2-cylinder water-cooled 4-cycle engine whose cylinders are banked forwardly and rearwardly in a V-shaped manner. The engine 17 is supported by the body frame 11 via a plurality of engine brackets 37 (only partially illustrated in FIG. 1) so that a crankshaft 105 may be oriented in a left-right horizontal direction relative to the vehicle body. The power of the engine 17 is transmitted to the rear wheel 22 via a drive shaft (not shown) disposed on the left side of the rear wheel 22.

The engine 17 is such that a V-angle (also called a bank angle) formed between a front bank 110A and a rear bank 110B both constituting corresponding cylinders is smaller than 90 degrees (e.g. 52 degrees). The respective valve trains of the banks 110A, 110B are each configured as a 4-valve double over head camshaft (DOHC) type.

An air cleaner 41 and a throttle body 42 constituting an engine air intake system are disposed in a V-shaped space defined between the front bank 110A and the rear bank 110B. The throttle body 42 supplies air purified by the air cleaner 41 to the front bank 110A and the rear bank 110B. The exhaust pipes 18A and 18B constituting an engine exhaust system are connected to the banks 110A and 110B, respectively. The exhaust pipes 18A and 18B pass on the right side of the vehicle body and connect with exhaust mufflers 19A and 19B, respectively, at their rear ends. Exhaust gas is discharged through the exhaust pipes 18A, 18B and corresponding exhaust mufflers 19A, 19B.

Figure 2:
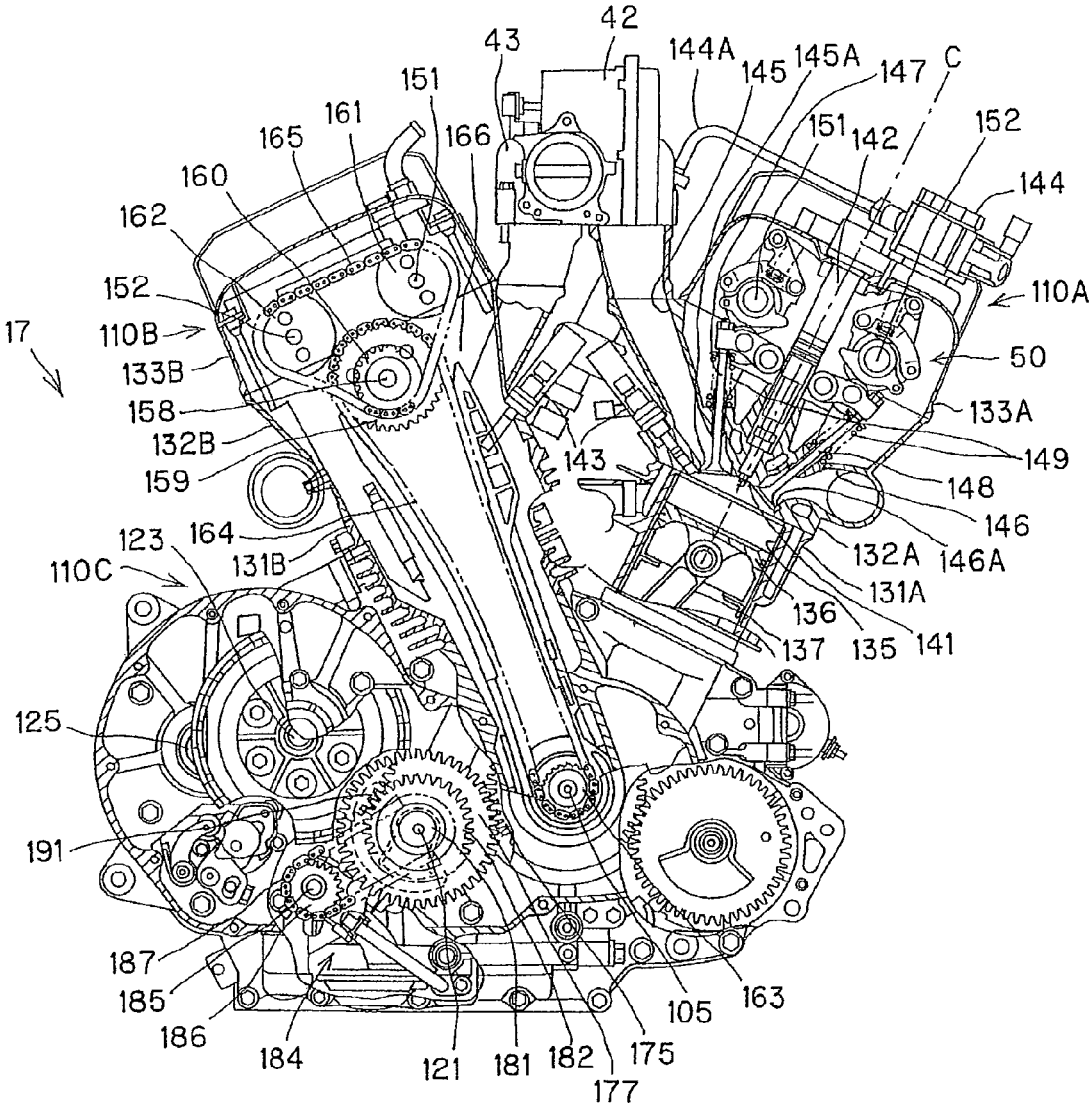
FIG. 2 illustrates an internal configuration of an engine as viewed from the side.
Figure 3:
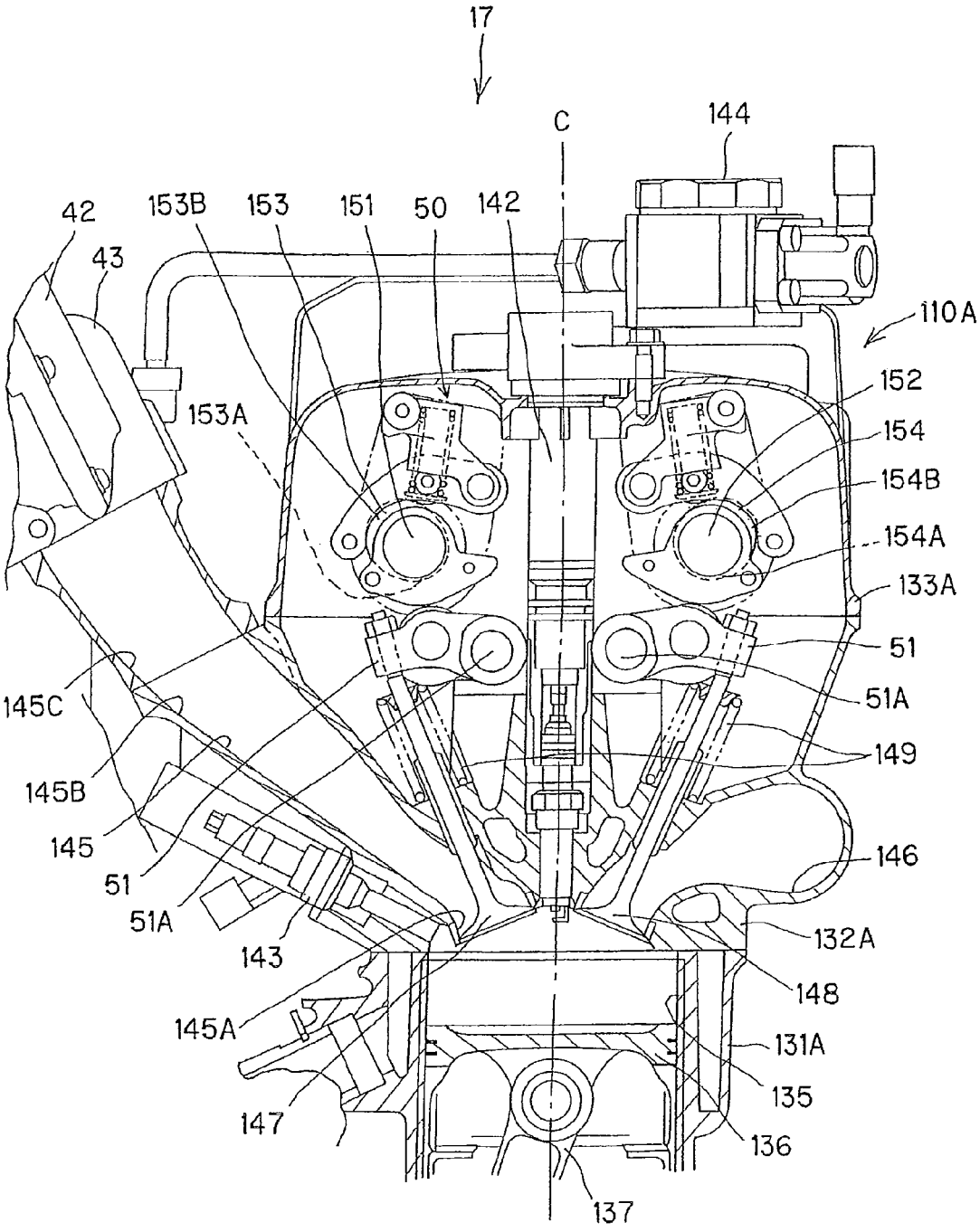
FIG. 3 is an enlarged view of an internal configuration of a front bank of FIG. 2.

FIG. 2 is a lateral view of an internal configuration of the engine 17 and FIG. 3 is an enlarged view of an internal configuration of the front bank 110A of FIG. 2.

Referring to FIG. 2, the front bank 110A and rear bank 110B of the engine 17 have the same configuration. FIG. 2 illustrates the vicinity of the piston in the front bank 110A and the vicinity of a cam chain in the rear bank 110B. In FIG. 2, an intermediate shaft 121 (a rear balancer shaft) is provided together with a main shaft 123 and a counter shaft 125. These shafts 121, 123, 125 including the crankshaft 105 are offset from one another in the back and forth, and up and down directions of the vehicle body so as to be arranged parallel to one another. A gear transmission mechanism configured to transmit the rotation of the crankshaft 105 to the intermediate shaft 121, the main shaft 123 and the counter shaft 125 in this order is disposed in a crankcase 110C supporting these shafts.

As illustrated in FIG. 2, a front cylinder block 131A and a rear cylinder block 131B are disposed on the upper surface of the crankcase 110C of the engine 17 so as to form a predetermined V-angle in the back and front of the vehicle body. A front cylinder head 132A and a rear cylinder head 132B are joined to the upper surfaces of the cylinder blocks 131A and 131B, respectively. Further, head covers 133A and 133B are mounted to the upper surfaces of the cylinder heads 132A and 132B, respectively. In this way, the front bank 110A and the rear bank 110B are configured.

The cylinder blocks 131A, 131B are each formed with a cylinder bore 135, into which a piston 136 is slidably inserted. The piston 136 is connected to the crankshaft 105 via a connecting rod 137.

The cylinder heads 132A, 132B are each formed in a lower surface with a combustion recessed portion 141 constituting a top surface of a combustion chamber formed above the piston 136. An ignition plug 142 is disposed such that its distal end faces the combustion recessed portion 141. In addition, the ignition plug 142 is provided generally concentrically with a cylinder axis C.

The engine 17 is a direct injection engine which directly injects fuel into the combustion chamber from an injector 143 provided on the combustion recessed portion 141. The injector 143 is disposed to be inserted from a V-bank inner lateral surface of each of the cylinder heads 132A, 132B so that its distal end faces the associated combustion recessed portion 141. The injector 143 is mounted so as to have an angle relative to the cylinder axis C.

A fuel pump 144 is disposed above the cylinder head 132A. Fuel is supplied from the fuel pump 144 via the fuel pipe 144A to the injectors 143.

The cylinder heads 132A, 132B are each formed with intake ports 145 communicating with the corresponding combustion recessed portion 141 at a pair of opening portions 145A and with exhaust ports 146 communicating with the combustion recessed ports 141 at a pair of opening portions 146A. The intake port 145 is disposed between the cylinder axis C and the injector 143.

As illustrated in FIGS. 2 and 3, the intake port 145 includes a lower intake port 145B provided integrally with each of the cylinder heads 132A, 132B, and an upper intake port 145C provided separately from each of the cylinder heads 132A, 132B. The upper intake port 145C is attached to the lower intake port 145B so as to have an angle varied in a direction coming closer to each of the head covers 133A, 133B.

The intake ports 145 merge into an intake chamber 43, which is joined to the throttle body 42. The throttle body 42 employs TBW (throttle by wire) which varies the sectional area of the throttle valve by driving of an actuator. An exhaust port 146 of the cylinder head 132A is joined to the exhaust pipe 18A (see FIG. 1). An exhaust port 146 of the cylinder head 132B is joined to the exhaust pipe 18B (see FIG. 1).

A pair of intake valves 147 (engine valves) for opening and closing the opening portions 145A of the intake ports 145 and a pair of exhaust valves 148 (engine valves) for opening and closing the opening portions 146A of the exhaust ports 146 are arranged on each of the cylinder heads 132A, 132B. The intake valves 147 and the exhaust valves 148 are biased by corresponding valve springs 149, 149 in a direction of closing the corresponding ports. The valve bodies 147, 148 are driven by a valve train 50 that can vary valve operating characteristics such as opening/closing timing, a lift amount, etc. The valve train 50 includes intake side and exhaust side camshafts 151 and 152 rotatably supported by the cylinder heads 132A and 132B, respectively, and rotated in conjunction with the rotation of the crankshaft 105. The camshafts 151, 152 are rotated in a counterclockwise rotating direction in FIGS. 2 and 4.

The camshaft 151 is formed integrally with an intake cam 153 (a drive cam). The intake cam 153 includes a base circular portion 153A (a base circle) forming a circular cam surface and a cam lobe portion 153B (a cam lobe) forming a cam surface projecting from the base circular portion 153A toward the external circumferential side. The camshaft 152 is formed integrally with an exhaust cam 154 (a drive cam). The exhaust cam 154 includes a base circular portion 154A (a base circle) forming a circular cam surface and a cam lobe portion 154B (a cam lobe) projecting from the base circular portion 154A toward the external circumferential side to form a lobe-like cam surface.

As illustrated in FIG. 2, the intermediate shaft 158 is rotatably supported on one end side in the width direction of each of the cylinder heads 132A, 132B and intermediate sprockets 159, 160 are secured to the intermediate shaft 158. A driven sprocket 161 is secured to one end side of the camshaft 151. A driven sprocket 162 is secured to one end side of the camshaft 152. A drive sprocket 163 is secured to both end sides of the crankshaft 105. A first cam chain 164 is wound between the sprockets 159, 163 and a second cam chain 165 is wound between the sprockets 160 to 162. The sprockets 159 to 163 and the cam chains 164, 165 are housed in a cam chain chamber 166 formed on one end side of each of the banks 110A, 110B.

A reduction ratio from the drive sprocket 163 to the driven sprockets 161, 162 is set to 2. If the crankshaft 105 is rotated, the drive sprocket 163 is rotated integrally with the crankshaft 105 to rotate the driven sprockets 161, 162 via the cam chains 164, 165 at a rotation speed half that of the crankshaft 105. In this way, the intake valves 147 and the exhaust valves 148 open and close the intake ports 145 and the exhaust ports 146, respectively, in accordance with the cam profiles of the camshafts 151, 152 rotated integrally with the driven sprockets 161, 162.

A generator not shown is provided at a left end portion of the crankshaft 105. A drive gear (hereinafter, called the crank side drive gear) 175 is secured to the right end of the crankshaft 105 and inside (on the left side of the vehicle body) the right drive sprocket 163 mentioned above. The crank side drive gear 175 meshes with a driven gear (hereinafter, called the intermediate side driven gear) 177 provided on the intermediate shaft 121. In addition, the crank side drive gear 175 transmits the rotation of the crankshaft 105 to the intermediate shaft 121 at a constant-speed to rotate it at the same speed as and reversely to that of the crankshaft 105.

The intermediate shaft 121 is rotatably supported rearward of and below the crankshaft 105 and forward of and below the main shaft 123.

An oil pump drive sprocket 181, the intermediate side driven gear 177 and a drive gear (hereinafter, called the intermediate side drive gear) smaller in diameter than the driven gear 177 are mounted in this order to the right end portion of the intermediate shaft 121.

The oil pump drive sprocket 181 is adapted to transmit the rotational force of the intermediate shaft 121 via a transmission chain 187 to a driven sprocket 186 to drive an oil pump 184. The driven sprocket 186 is secured to a drive shaft 185 of the oil pump 184 disposed rearward of the intermediate shaft 121 and below the main shaft 123.

The intermediate side drive gear 182 meshes with a driven gear (hereinafter, called the main side driven gear) 191 provided rotatably relatively on the main shaft 123 to reduce the rotation speed of the intermediate shaft 121 and transmit it to the main shaft 123 via a clutch mechanism (not shown). That is to say, the reduction ratio from the crankshaft 105 to the main shaft 123, i.e., a primary reduction ratio of the engine 17 is set based on the reduction ratio between the intermediate side drive gear 182 and the main side driven gear 191.

The main shaft 123 is rotatably supported rearwardly of and above the crankshaft 105 and the counter shaft 125 is rotatably supported generally rearward of the main shaft 123. Speed-change gear groups not shown are arranged to straddle the main shaft 123 and the counter shaft 125 to constitute a transmission device.

A drive shaft (not shown) extending in the back and forth direction of the vehicle body is coupled to a left end portion of the counter shaft 125. Thus, the rotation of the counter shaft 125 is transmitted to the drive shaft.

Figure 4:
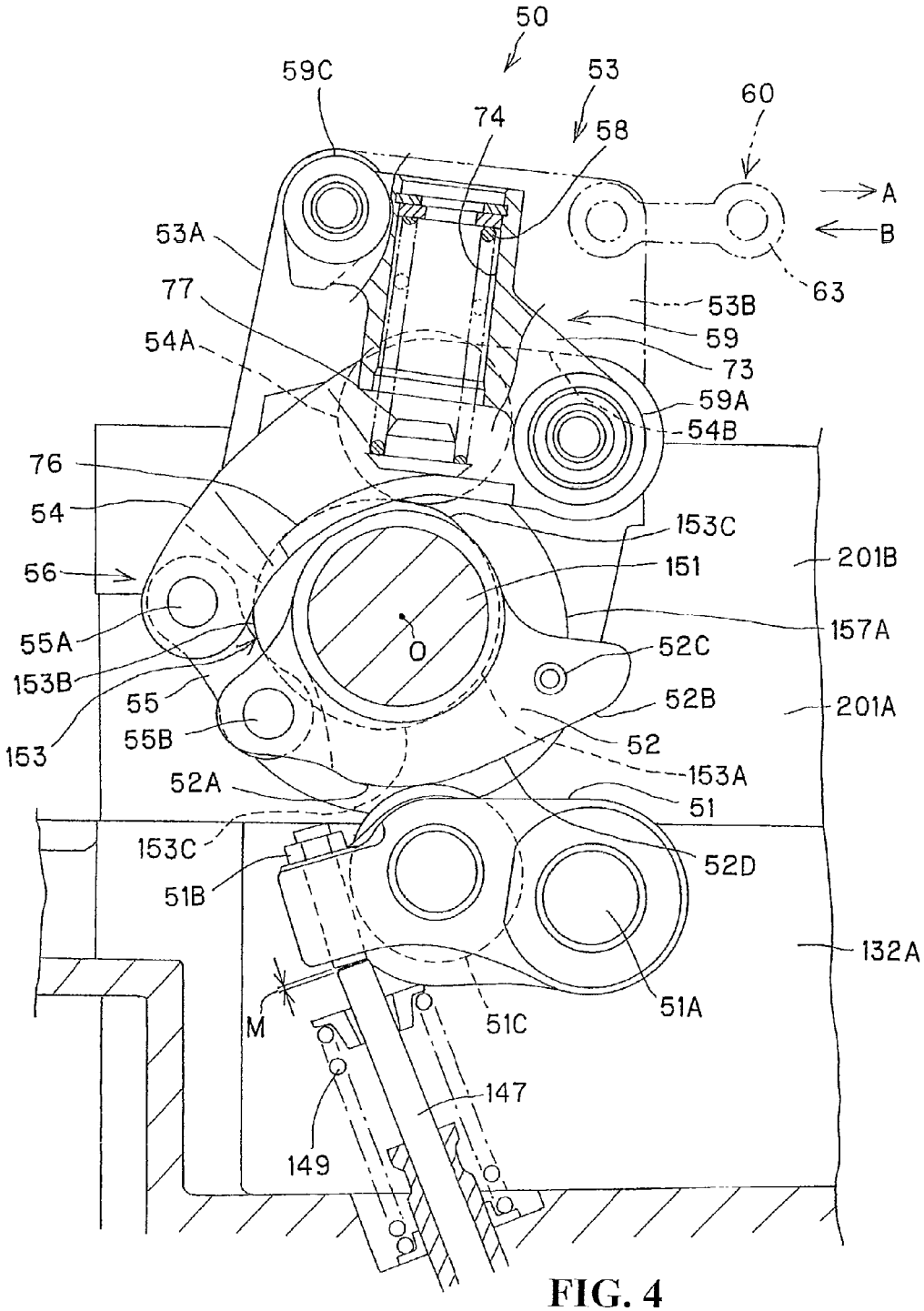
FIG. 4 is a partial broken-away lateral view of a valve train.
Figure 5:
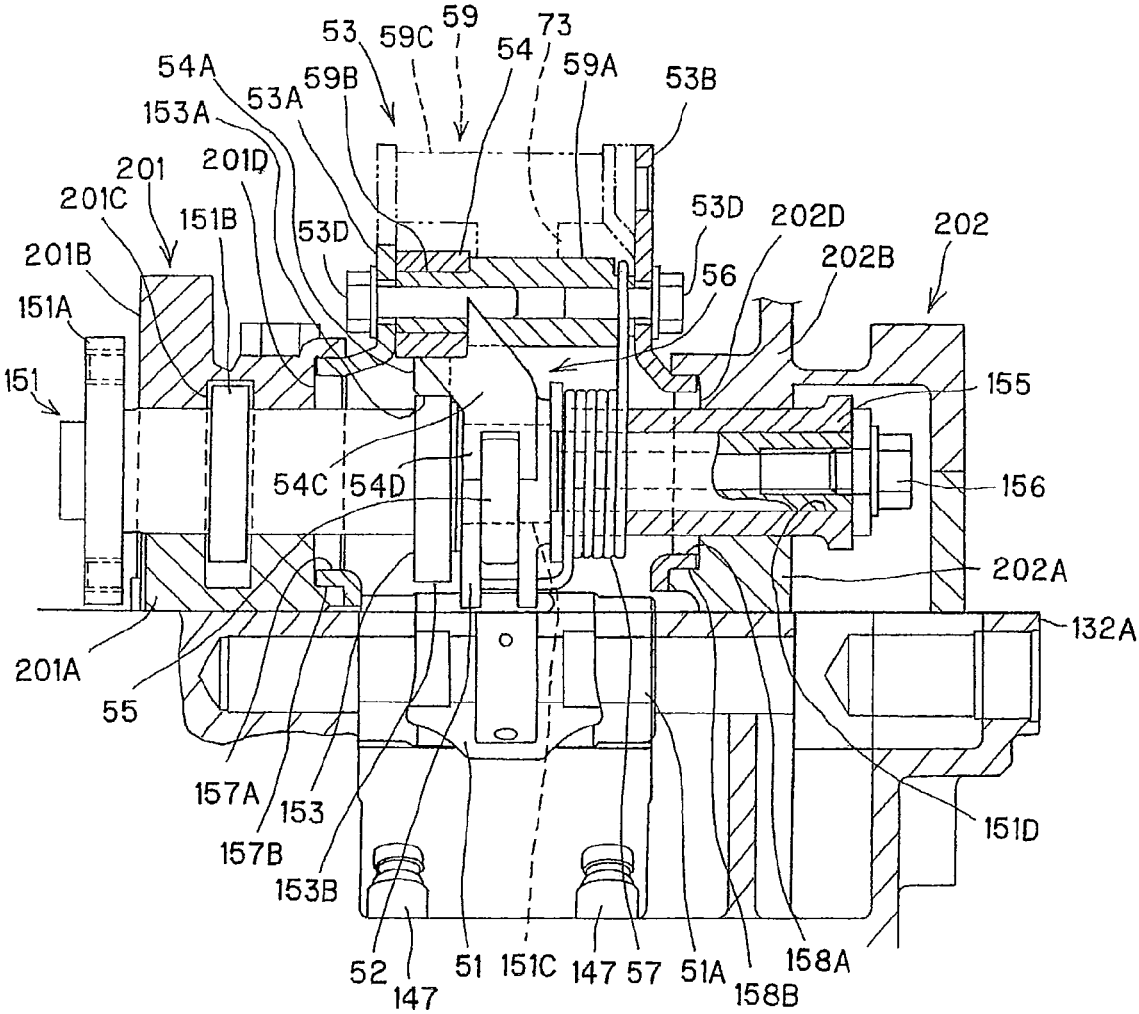
FIG. 5 is a longitudinal cross-sectional view of a valve train of the front bank as viewed from the rear side.
Figure 6:
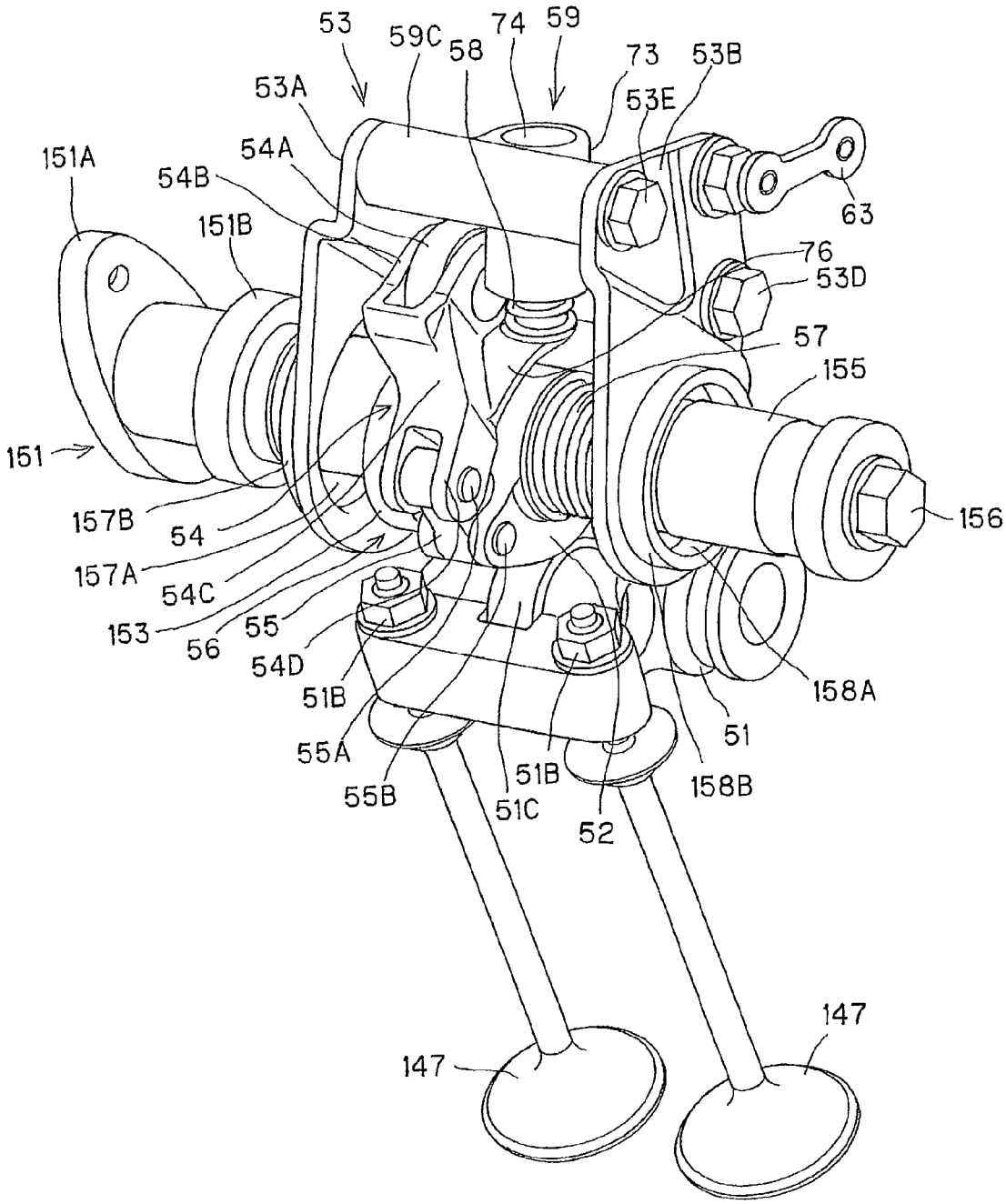
FIG. 6 is a perspective view of the valve train.

FIG. 4 is a partially broken-out lateral view of the valve train 50 and FIG. 5 is a longitudinal cross-sectional view of the valve train 50 of the front bank 110A as viewed from the rear side. FIG. 6 is a perspective view of the valve train 50.

As illustrated in FIG. 3, the valve trains 50 are provided on the intake side and on the exhaust side symmetrically to the cylinder axis C and independently of each other. Since the respective valve trains 50 of the front bank 110A and the rear bank 110B have generally the same configuration, the valve train 50 on the intake side of the front bank 110A is described in the present embodiment.

Referring to FIGS. 4 to 6, the valve train 50 includes the camshaft 151 (the camshaft 152 on the exhaust side); the intake cam 153 (the exhaust cam 154 on the exhaust side) rotated integrally with the camshaft 151; and a rocker arm 51 opening and closing the intake valves 147 (the exhaust valves 148 on the exhaust side). The valve train 50 further includes a valve operating cam 52 relatively rotatably supported by the camshaft 151 and opening and closing the intake valves 147 via the rocker arm 51; a holder 53 swingable around the camshaft 151; a link mechanism 56 swingably supported by the holder 53 to transmit the valve driving force of the intake cam 153 for swinging the valve operating cam 52; and a drive mechanism 60 swinging the holder 53. The link mechanism 56 includes a sub-rocker arm 54 connected to the holder 53 and a connecting link 55 swingably connecting the sub-rocker arm 54 with the valve operating cam 52.

The rocker arm 51 is formed wide so that one rocker arm 51 opens and closes the pair of intake valves 147. The rocker arm 51 is swingably supported at one end by a rocker arm pivot 51A secured to the cylinder head 132A. Screw-type adjustment portions 51B are provided at the other end of the rocker arm 51 so as to come into abutment against the upper ends of the intake valves 147. A roller 51C is rotatably supported by the central portion of the rocker arm 51 so as to come into contact with the valve operating cam 52.

A predetermined amount of valve clearance M adjustable by the adjustment portion 51B is provided between the upper end portion of each of the intake valves 147 and the lower end of each of the adjustment portions 51B. The valve clearance M becomes equal to 0 when the lower end of the adjustment portion 51B comes into contact with the upper end portion of the intake valve 147 at the time of the opening operation of the intake valve 147.

Referring to FIGS. 5 and 6, the camshaft 151 has on one end side a sprocket securing portion 151A to which the driven sprocket 161 (see FIG. 2) is secured. In addition, in order from the sprocket securing portion 151A, a positioning portion 151B, the intake cam 153, a valve operating cam supporting portion 151C and a collar fitting portion 151D are provided. The positioning portion 151B is formed circular in cross-section to project from the outer circumference of the camshaft 151. The valve operating cam supporting portion 151C swingably supports the valve operating cam 52. The collar fitting portion 151D is formed to have a diameter smaller than that of the valve operating cam supporting portion 151C. A camshaft collar 155 functioning as a bearing of the camshaft 151 is fitted to the collar fitting portion 151D. The camshaft collar 155 is pressed against the valve operating cam 52 by a securing bolt 156 fastened to the other end side of the camshaft 151.

The camshaft 151 is rotatably supported at both ends by camshaft supporting portions 201, 202. More specifically, the camshaft support portions 201, 202 are configured such that caps 201B and 202B, each having a support portion semicircular in cross-section, are secured to head side support portions 201A and 202A, respectively, formed on the upper portion of the cylinder head 132A. The camshaft support portion 201 provided on the side of the positioning portion 151B is formed with a groove 201C shaped to conform to the shape of the positioning portion 151B. The position of the positioning portion 151B is restricted by the groove 201 to axially position the camshaft 151.

Holder support portions 201D and 202D supporting the holder 53 are provided on the surfaces of the camshaft support portions 201 and 202, respectively, on the side of the intake cam 153.

The valve operating cam 52 is pivotally supported by the valve operating cam support portion 151C provided at the intermediate portion of the camshaft 151. As illustrated in FIG. 4, the valve operating cam 52 is formed with a base circular portion 52A adapted to maintain the intake valves 147 in a closed state and with a cam lobe portion 52B adapted to press down the intake valve 147 to open it. The cam lobe portion 52B is formed with a through-hole 52C. A valve operating cam return spring 57 (see FIG. 5) is attached at one end to the through-hole 52C. The valve operating cam returning spring 57 is adapted to bias the valve operating cam 52 in a direction where the cam lobe portion 52B is moved away from the roller 51C of the rocker arm 51, i.e., in a direction of closing the intake valves 147. As illustrated in FIG. 5, the valve operating cam return spring 57 is wound around the camshaft 151 and is attached to the holder 53 at the other end.

The holder 53 includes first and second plates 53A, 53B holding the intake cam 153 and the valve operating cam 52 and spaced at a predetermined interval from each other in the axial direction of the camshaft 151; and a connecting member 59 connecting together the first and second plates 53A, 53B in the axial direction of the camshaft 151. The first plate 53A is disposed at one end side of the camshaft 151 to which the driven sprocket 161 is secured. The second plate 53B is disposed at the other end side of the camshaft 151.

The connecting member 59 has a shaft portion 59A parallel to the camshaft 151. The shaft portion 59A is formed at an end close to the first plate 53A with a sub-rocker arm support portion 59B connected to one end of the sub-rocker arm 54. The connecting member 59 is secured to the first and second plates 53A, 53B by means of a pair of bolts 53D inserted into both the ends of the shaft portion 59A from the external surface sides of the first and second plates 53A, 53B. The connecting member 59 includes a shaft portion 59C parallel to the shaft portion 59A as shown in FIG. 4. In addition, the connection member 59 is secured to the first and second plates 53A, 53B also by means of a pair of bolts 53E (see FIG. 6) inserted into both the ends of the shaft portion 59C from the external surface sides of the first and second plates 53A, 53B. The shaft portion 59A and the shaft portion 59C are joined together by a joint portion 73 located at an intermediate portion in the distance between the first plate 53A and the second plate 53B.

The first and second plates 53A and 53B have shaft holes 157A and 158A, respectively, adapted to receive the camshaft 151 passed therethrough as shown in FIG. 5. The respective circumferential edge portions of the shaft holes 157A and 158A serve as circular projecting portions 157B and 158B projecting toward the holder support portions 201D and 202D, respectively. The holder 53 is supported by the projecting portions 157B and 158B fitted respectively to the holder support portions 201D and 202D, so as to be swingable around the camshaft 151.

The sub-rocker arm 54, along with the intake cam 153 and the valve operating cam 52, is disposed between the first and second plates 53A, 53B. In addition, the sub-rocker arm 54 is rotatably supported at one end by the sub-rocker arm support portion 59B of the connecting member 59 so as to be swingable around the sub-rocker arm support portion 59B. A roller 54A is rotatably supported by the central portion of the sub-rocker arm 54 so as to come into contact with the intake cam 153 and press the base circular portion 153A and the cam lobe portion 153B. One end of the connecting link 55 is connected to the other end portion of the sub-rocker arm 54 via a pin 55A swingably supporting the connecting link 55. In addition, the other end of the connecting link 55 is connected to the valve operating cam 52 via a pin 55B swingably supporting the valve operating cam 52.

The sub-rocker arm 54 is biased by a sub-rocker arm return spring 58 (hereinafter, called the return spring) housed in a cylindrical housing portion 74 of the connecting member 59. Thus, the roller 54A of the sub-rocker arm 54 is constantly pressed against the intake cam 153. The return spring 58 that is disclosed is a coil spring.

The sub-rocker arm 54 includes a holder connecting portion 54B joined to the sub-rocker arm support portion 59B and extending perpendicularly to the camshaft 151; an eccentric portion 54C curved downward from the holder connecting portion 54B along the outer diameter of the camshaft 151; and a link portion 54D connected to the valve operating cam 52 via the connecting link 55.

The eccentric portion 54C is eccentric in the axial direction of the camshaft 151 from the side of the first plate 53A toward the second plate 53B so as to avoid the intake cam 153. In addition, the eccentric portion 54C is formed on a lateral surface with a plate-like stepped portion 76 protruding in the axial direction of the camshaft 151. As illustrated in FIGS. 4 and 6, the stepped portion 76 is provided to curve along the lower edge portion of the sub-rocker arm 54. The lower end of the return spring 58 is received by the stepped portion 76 via a spring washer 77.

The link portion 54D is provided to merge with the end of the eccentric portion 54C and is joined to the valve operating cam 52. As described above, since the eccentric portion 54C is eccentric, the sub-rocker arm 54 connects together the intake cam 153 and the valve operating cam 52 located at respective positions different from each other in the axial direction of the camshaft 151.

A description is next given of the operation of the valve train 50.

Referring to FIG. 4, in the valve train 50 configured as described above, if the camshaft 4 is rotated counterclockwise in FIG. 4, the intake cam 153 rotated integrally with the camshaft 151 allow the cam lobe portion 153B to lift the sub-rocker arm 54 via the roller 54A and swing around the shaft portion 59A. Along with this, the valve operating cam 52 is rotated clockwise in FIG. 4 around the camshaft 151 via the connecting link 55. The rotation of the valve operating cam 52 allows the cam lobe portion 52B to press down the intake valve 147 together with the rocker arm 51 via the roller 51C, opening the intake valves 147.

In the state where the camshaft 151 is further rotated to bring the base circular portion 153A of the intake cam 153 into abutment against the roller 54A, the sub-rocker arm 54 is pressed down by the return spring 58. At the same time, the valve operating cam 52 is rotated counterclockwise in FIG. 4 by the valve operating cam return spring 57 to bring the base circular portion 52A into abutment against the roller 51C. In this way, the intake valves 147 are pressed up and closed by the valve spring 149 (see FIG. 2).

As illustrated in FIG. 4, the valve train 50 is such that the connecting link member 63 is connected to the holder 53. If the connecting link member 63 is shifted in a direction of arrow A, the link mechanism 56, along with the holder 53, is swung clockwise around the axial center of the intake side camshaft 151. In addition, the roller 54A is swung clockwise and the valve operating cam 52 is swung clockwise. On the other hand, if the connecting link member 63 is shifted in a direction of arrow B, the link mechanism 56, along with the holder 53, is swung counterclockwise around the axial center of the intake side camshaft 151. In addition, the roller 54A is swung counterclockwise and the valve operating cam 52 is swung counterclockwise. In this way, the valve train 50 is configured so that valve operating characteristics of the intake valve 147 and of the exhaust valve 148, i.e., opening/closing timing, opening/closing periods and an lift amount of the exhaust valve 148 can be controlled by varying the position of the roller 54A and the initial position of swing of the valve operating cam 52.

The initial position of swing of the valve operating cam 52 here means a swing position of the valve operating cam 52 in the state where the roller 54A is in abutment against the base circular portion 153A of the intake cam 153 and the sub-rocker arm 54 is not lifted by the cam lobe portion 153B.

Figure 7:
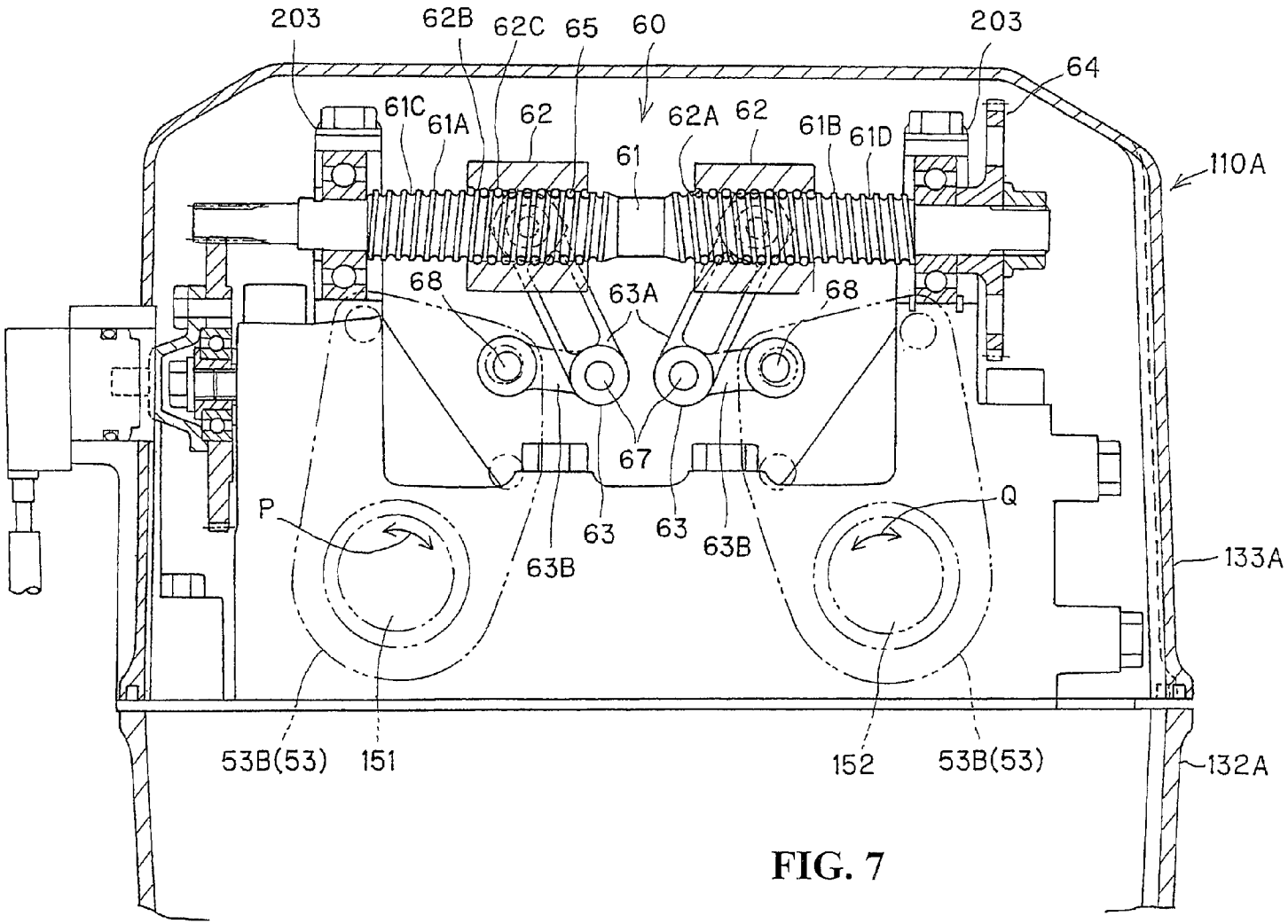
FIG. 7 is a longitudinal cross-sectional view of a drive mechanism as viewed from the side.

Referring to FIG. 7, the connecting link member 63 is connected to the drive mechanism 60.

Figure 8:
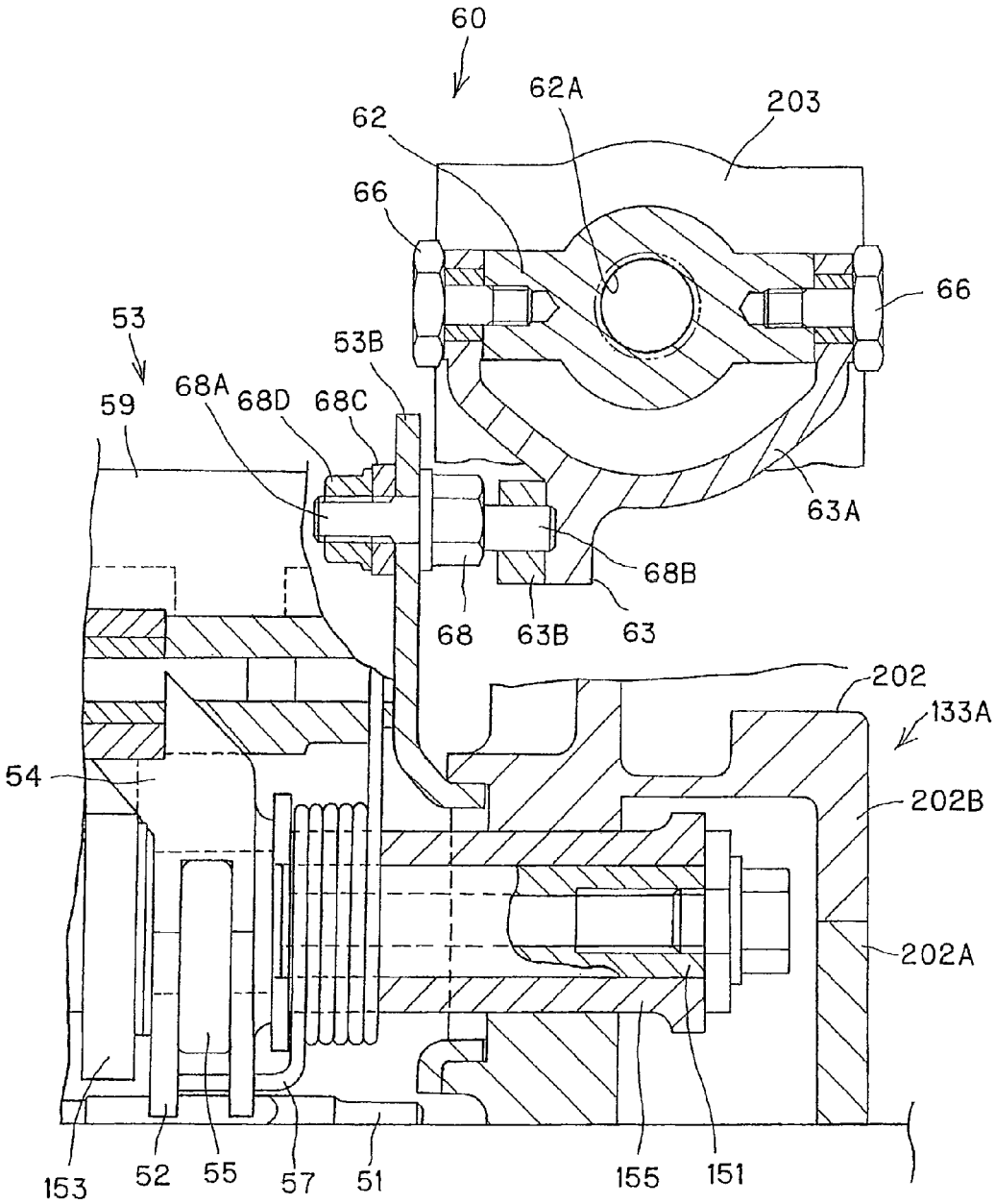
FIG. 8 is a longitudinal cross-sectional view of the drive mechanism as viewed from the front.

FIG. 7 is a longitudinal cross-sectional view of the drive mechanism 60 as viewed from the side and FIG. 8 is a longitudinal cross-sectional view of the drive mechanism 60 as viewed from the front.

As illustrated in FIG. 7, the drive mechanism 60 is connected to the holders 53 via the respective connecting link members 63. The drive mechanism 60 includes a ball screw 61 disposed to be spanned between the intake side camshaft 151 and the exhaust side camshaft 152; and two respective nuts 62 provided on the intake side and exhaust side so as to be axially shiftable on the ball screw 61. The connecting link member 63 is provided between the nuts 62 and the holders 53.

A gear 64 is secured to an end of the ball screw 61. An electrically-driven actuator not illustrated is connected via a gear train to the gear 64. The electrically-driven actuator is controlled by an electronically controlled unit (ECU). By the ECU driving the electrically-driven actuator, the holder 53 is swung via the ball screw 61 so that the operative characteristics of opening and closing the intake valves 147 and the exhaust valves 148 are controlled in accordance with the operating conditions of the engine 17.

The ball screw 61 is disposed, perpendicularly to the camshafts 151, 152, on the other side of the camshafts 151, 152, i.e., on the side opposite the side where the driven sprockets 161, 162 are secured. As mentioned above, the ball screw 61 does not extend in the vertical direction of the engine 17 but are disposed to be spanned between the intake-side camshaft 151 and the exhaust-side camshaft 152. Therefore, the height of the engine 17 can be suppressed to a low level. As illustrated in FIG. 7, the ball screw 61 is rotatably supported at both ends by a ball screw support portion 203 provided above the cylinder head 132A.

Referring to FIG. 7, the ball screw 61 is formed on the outer circumferential surface with a helical screw thread 61A and a helical thread groove 61C on the intake side and with a helical screw thread 61B and a helical thread groove 61D on the exhaust side. The thread 61A and thread groove 61C, and the thread 61B and thread groove 61D are set differently in a winding direction from each other between the intake side and the exhaust side.

The nut 62 has a through-hole 62A adapted to receive the ball screw 61 pass therethrough. The through-hole 62A is formed on an inner circumferential surface with a helical nut-thread 62B corresponding to the threads 61A, 61B and with helical nut thread grooves 62C corresponding to the shaft thread grooves 61C, 61D. A plurality of rollable balls 65 are disposed between the nut thread grooves 62C and the shaft thread grooves 61C, 61D. The rotation of the ball screw 61 allows the nuts 62 to travel on the ball screw 61 via the balls 65.

Referring to FIGS. 7 and 8, the connecting link member 63 includes a nut-side link 63A whose one end is secured to the nut 62 and a holder-side link 63B connecting the other end of the nut-side link 63A with the second plate 53B.

The one end portion of the nut-side link 63A holds the nut 62 from both lateral sides and is secured to the nut 62 by means of bolts 66. The other end portion of the nut-side link 63A is swingably supported by the one end portion of the holder-side link 63B via a pin 67. The other end portion of the holder-side link 63B is swingably supported by the second plate 53B via an eccentric pin 68. The eccentric pin 68 is configured to include a hexagon bolt 68A and an eccentric shaft 68B formed eccentrically to and integrally with the head of the hexagon bolt 68A. The hexagon bolt 68A is secured to the second plate 53B by means of a spring washer 68C and a hexagon nut 68D. The eccentric shaft 68B is turnably supported by the nut-side link 63A.

In FIG. 7, if the holders 53 are swung in directions of arrows P, Q, the link mechanisms 56 shown in FIG. 4 are swung around the corresponding camshafts 151, 152. In addition, the valve trains 50 are configured generally symmetrically to each other in the back and forth direction with respect to the cylinder axis C; therefore, the valve train 50 on the side of the intake side camshaft 151 is described.

The positional variation of the link mechanism 56 swings the roller 54A and the valve operating cam 52 around the camshaft 151 to displace their circumferential positions with respect to the camshaft 151. Thus, the swing phase and initial position of the swing of the valve operating cam 52 relative to the rotation of the intake cam 153 are varied. In this way, the swing phase and swing position of the valve operating cam 52 with respect to the intake cam 153 is varied to vary timing and a period in which the cam lobe portion 52B of the valve operating cam 52 is in abutment against the roller 51C and an amount in which the cam lobe portion 52B presses down the roller 51C. Thus, the opening/closing timing, opening period and lift amount of the intake valve 147 can be varied.

For example, the ball screw 61 is turned to move the nuts 62 toward the central side of the ball screw 61 and the holders 53 are further swung clockwise in FIG. 4 by the connecting link members 63. In this case, the roller 54A and the valve operating cam 52 are turned clockwise so that the cam lobe portion 52B comes close to the roller 51C. In this state, the camshaft 151 is turned to advance the start timing of allowing the cam lobe portion 153B to lift the roller 54A and also of allowing the cam lobe portion 52B to increase the period and amount of pressing down the roller 51C. Thus, the opening timing of the intake valve 147 is advanced and the opening period and lift amount of the intake valve 147 is increased.

Figure 9:
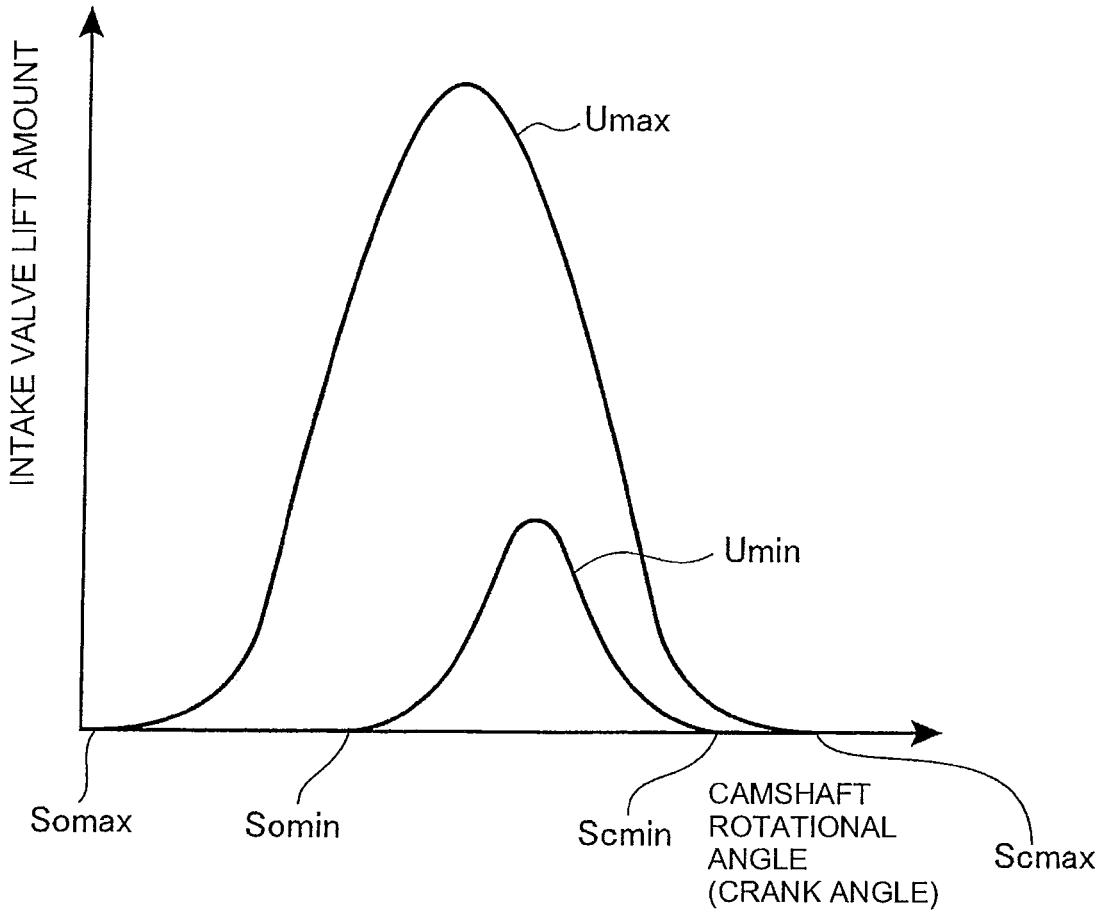
FIG. 9 illustrates valve operating characteristics of an intake valve.

FIG. 9 illustrates valve operating characteristics of the intake valve 147, in which a horizontal axis represents a rotation angle and a longitudinal axis represents a lift amount of the intake valve 147.

Referring to FIG. 9, the intake valve 147 is varied in opening/closing timing, opening/closing period and a maximum lift amount by the valve train 50 driven by the drive mechanism 60. In addition, the intake valve 147 is operatively opened/closed in any valve characteristics between a maximum valve characteristic Umax in which the lift amount of the intake valve 147 is maximized and a minimum valve characteristic Umin in which the lift amount of the intake valve 147 is minimized, with the maximum valve characteristic Umax and the minimum valve characteristic Umin taken as respective boundary values. In FIG. 9, opening timing and closing timing of the maximum valve operating characteristic Umax are indicated with a most advance angle position Somax and a most retard angle position Scmin, respectively. In addition, an opening timing and a closing timing of the minimum valve operating characteristic Umin are indicated with a most retard position Somin and a most advance angle position Scmin, respectively.

In the intake valve 147, as its opening timing is continuously retarded, its closing timing is continuously advanced, so that the opening period is continuously reduced. Further, as the rotational angle of the camshaft 151 in which the maximum lift amount can be obtained is continuously retarded, the maximum lift amount can continuously be reduced. The swing position of the valve operating cam 52 shown in FIG. 4 is an initial position of swing providing the minimum valve operating characteristic Umin. The holder 53 is swung from this state by the drive mechanism 60 to swing the valve operating cam 52 to the limit of the initial position of the swing in the clockwise direction in FIG. 4. Thus, the valve operating cam 52 reaches a swing position providing the maximum valve operating characteristic Umax.

Figure 10:
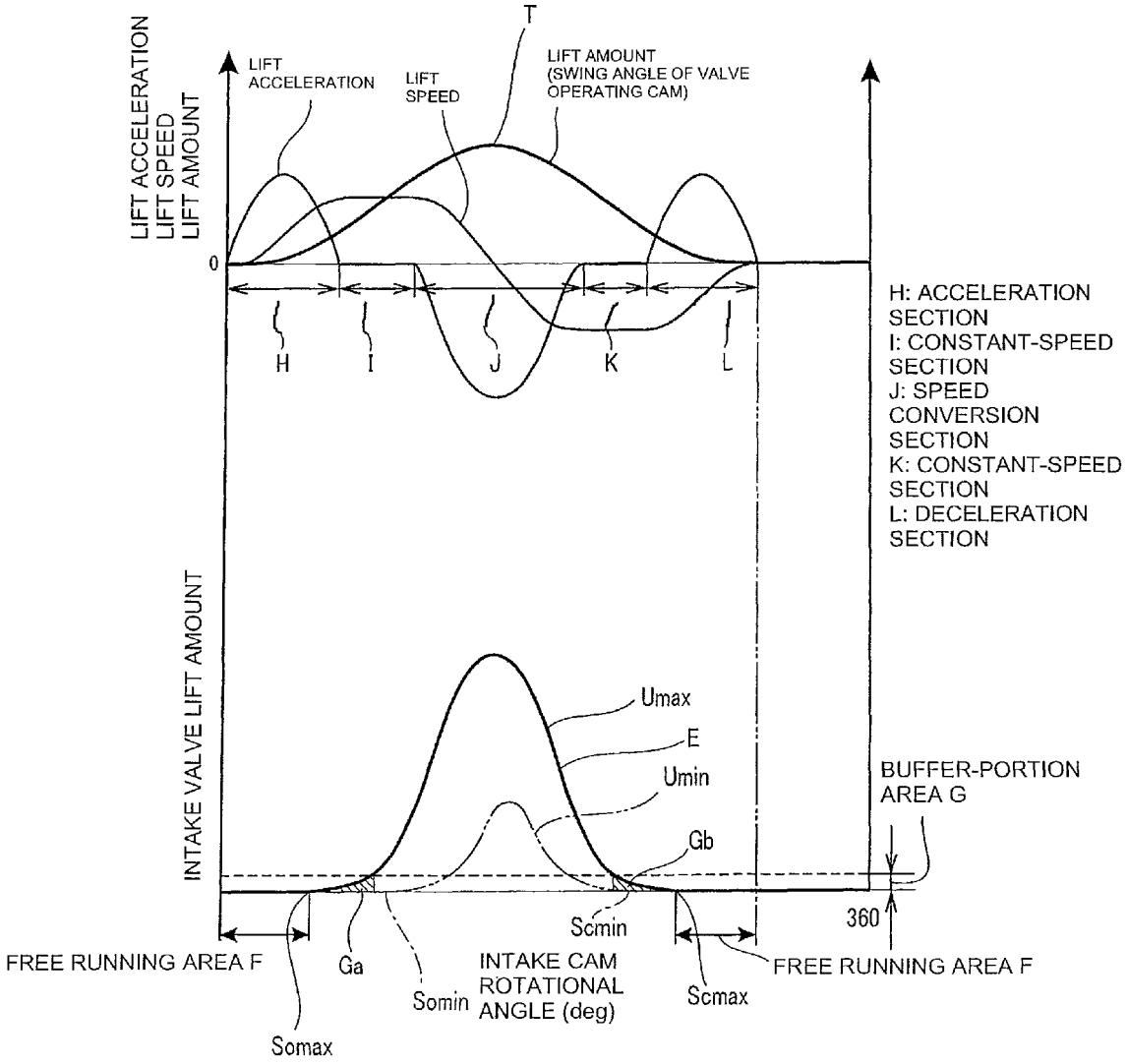
FIG. 10 is a graph showing operating characteristics of an intake cam and of the intake valve.

FIG. 10 is a graph illustrating the operating characteristics of the intake cam 153 and the intake valve 147 in the state of the maximum valve operating characteristic Umax. A horizontal axis represents a rotational angle of the intake cam 153. In addition, a longitudinal axis represents a lift amount of the cam lobe portion 153B, a lift speed of the cam lobe portion 153B, lift acceleration of the cam lobe portion 153B, and a lift amount of the intake valve 147. The lift amount of the cam lobe portion 153B means the height of the cam lobe portion 153B is increased along with the rotation of the intake cam 153. The lift speed and the lift acceleration mean are a varying rate of the height of the cam lobe portion 153B and acceleration at that time, respectively.

As shown in FIG. 4, the base circular portion 153A of the intake cam 153 is formed of a circular arc whose radius from its center O is uniform and the cam lobe portion 153B is formed of a circular arc whose radius from the center O is radially increased and then decreased. The intake cam 153 is such that a curve line indicating the lift amount of the cam lobe portion 153B shown in FIG. 10 is formed to have a symmetrical shape on the basis of a top T of this curve line. However, although the curve line indicating the lift amount of the cam lobe portion 153B is designed symmetrically on the basis of the top T in this embodiment, it is not necessarily that the curve line is symmetrical. The curve line may be asymmetrical.

The intake cam 153 is provided, between the base circular portion 153A and the cam lobe portion 153B, with an intake cam buffer portion 153C whose height from the base circular portion 153A is gently increased from "0." This intake cam buffer portion 153C corresponds to an acceleration section H in which the lift speed of the cam lobe portion 153B gradually increases from "0" as shown in FIG. 10.

As illustrated in FIG. 4, the valve operating cam 52 is provided, between the cam lobe portion 52B and the base circular portion 52A, with a buffer portion 52D whose height from the base circular portion 52A is gently increased from "0." This buffer portion 52D corresponds to a buffer-portion area G in which the lift amount of the intake valve 147 is gradually increased from "0" in a generally linear manner or gradually decreased to "0" in a generally linear manner. The buffer-portion area G is provided at each of the opening and closing timings of the intake valve 147. In addition, the opening and closing of the intake valve 147 are started at the corresponding buffer-portion areas G. An area above the buffer-portion area G is a lift area E in which the lift amount of the intake valve 147 is largely increased.

The valve clearance M becomes equal to "0" when the roller 51C is started to be pressed downward by the valve operating cam 52 to press downward the lower end of the adjustment portion 51B by an amount corresponding to the valve clearance M. It is when the valve clearance M becomes equal to "0" that the lift amount of the intake valve 147 is started to increase from "0." In FIG. 10, this corresponds to the most advance angle position Somax and to the most retard angle position Somin. The intake valve 147 is closed at the most retard angle position Scmax and at the most advance angle position Scmin. Thereafter, along with the rotation of the intake cam 153, the valve clearance M becomes positive values from 0 and the intake valve 147 sits on a valve seat.

The base circular portion 52A (the base circle of the valve operating cam) of the valve operating cam 52 has a free running area F where the intake valve 147 is not lifted even if the valve operating cam 52 is swung. In other words, the free running area F is an area where the valve operating cam 52 is swung with the base circular portion 52A of the valve operating cam 52 being in abutment against the roller 51C of the rocker arm 51.

As shown in FIG. 10, the intake cam 153 is formed to have the acceleration section H continuous with the base circular section 52A and a constant-speed section I provided continuously with the acceleration section H to offer a constant lift speed of the cam lobe portion 153B. In addition, the intake cam 153 is formed to have a speed conversion section J provided continuously with the constant-speed portion Ito convert the lift speed of the cam lobe portion 153B from positive to negative, a constant-speed section K where the lift amount decreases at a constant lift speed, and a deceleration section L where the lift amount gradually lowers and becomes equal to "0."

The intake cam 153 is formed such that a curve line representing the lift mount is symmetric with respect to an angle position of the top T where the lift amount of the cam lobe portion 153B is maximized.

The sub-rocker arm 54 is swung around the sub-rocker arm support portion 59B by a swing amount proportional to the lift amount of the intake cam 153 to swing the valve operating cam 52. If the swing angle of the valve operating cam 52 is plotted on the longitudinal axis of FIG. 10, the swing angle of the valve operating cam 52 varies along almost the same curve line as that of the lift amount of the intake cam 153.

The intake valve 147 is opened in a valve-opening section from the acceleration section H to the top H and maximized in lift amount at a position corresponding to the top T of the intake cam 153. In addition, the intake valve 147 is closed along the curve line of lift amount symmetrical with that of the valve-opening section, in a valve-closing section from the top T to the terminal end of the deceleration section L.

The acceleration section H is a section where lift acceleration is positive. In a front-half section of the acceleration H, the lift acceleration increases from "0" in parabolic form. In a rear-half section, the lift acceleration lowers in parabolic form. At the terminal end of the acceleration section H, the lift acceleration is equal to "0." In the acceleration section H, the sub-rocker arm 54 is swung to drive the valve operating cam 52 while obtaining swing acceleration corresponding to the lift acceleration of the acceleration section H. In the state of the maximum valve-operating characteristic Umax shown in FIG. 10, the acceleration section H is started simultaneously with the start of the free running area F and ended in the opening side buffer-portion area Ga on the valve-opening side.

The constant-speed section I is a section where the lift acceleration is equal to "0." In the constant-speed section I, the lift speed accelerated in the acceleration section H is kept constant and the lift amount increases. In the constant-speed section I, the swing speed (the swing angle speed) of the sub-rocker arm 54 becomes constant. In the state of the maximum valve operating characteristic Umax shown in FIG. 10, the constant-speed section I includes the open side buffer-portion area Ga on the valve-opening side.

The speed conversion section J is a section where the lift acceleration is negative. In a front-half portion, the lift speed is reduced. At the top T, the lift speed becomes equal to "0." In a rear-half portion, the lift speed is increased in a direction of reducing the lift amount.

The constant-speed section K is a section where the lift acceleration is equal to "0." In the constant-speed section K, the lift amount decreases at a constant speed. In the state of the maximum valve-operating characteristic Umax shown in FIG. 10, the constant-speed section K includes a closing side buffer-portion area Gb on the valve-closing side.

The deceleration section L is a section where the lift acceleration is positive. In addition, the lift speed is reduced as the terminal end is gradually reached and at the terminal end, the lift acceleration, lift speed and lift amount are equal to "0." In the maximum valve-operating characteristic Umax shown in FIG. 10, the deceleration section L is started in the buffer-portion area G on the valve-closing side and terminates simultaneously with the termination of the free running area F.

Figure 11:
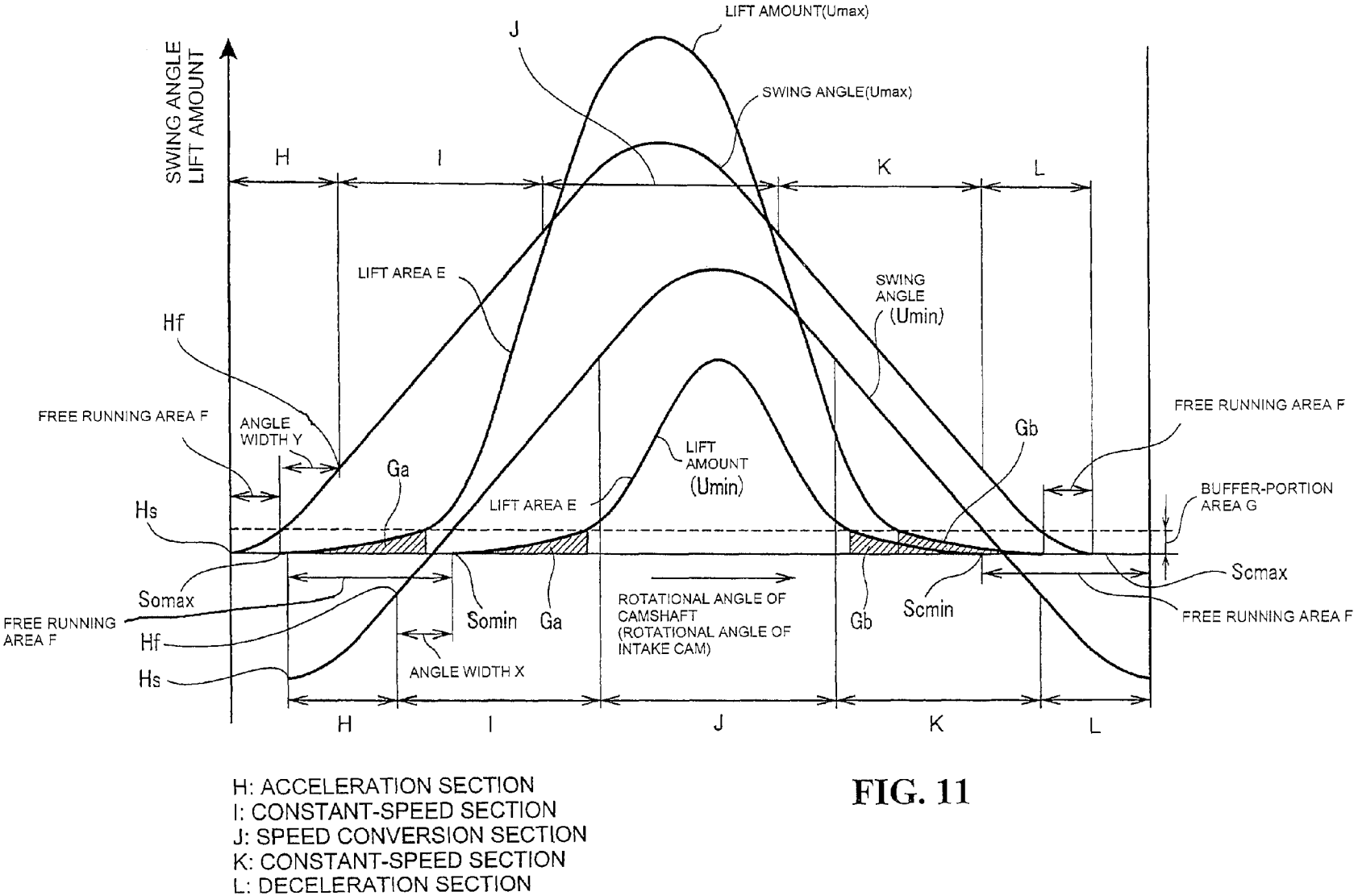
FIG. 11 is a graph showing variations in the swing angle of a valve operating cam and in the lift amount of the intake valve with respect to a rotational angle of a camshaft.

FIG. 11 is a graph showing variations of a swing angle of the valve operating cam 52 and of a lift amount of the intake valve 147 with respect to a rotational angle of the camshaft 151 (a rotational angle of the intake cam 153) in the maximum valve operating characteristic Umax and in the minimum valve operating characteristic Umin. The swing angle of the valve operating cam 52 varies along almost the same curve line as that of the lift amount of the intake cam 153 as described above. FIG. 11 shows the respective ranges of acceleration sections H, constant-speed sections I, speed conversion sections J, constant-speed sections K and deceleration sections L corresponding to curve lines representing the swing angle of the valve operating cam 52.

Referring to FIG. 11, in the maximum valve operating characteristic Umax, a start point Hs of the corresponding acceleration section H is located at a start point of a free running area F and an increase in the lift amount of the intake cam 153 is started simultaneously with the start of the free running area F. A terminal end Hf of the acceleration section H is located within an open side buffer-portion area Ga of the maximum valve operating characteristic Umax. The acceleration of the lift speed of the intake cam 153 is ended in the open side buffer-portion area Ga. A most advance angle position Somax corresponding to the opening timing of the intake valve 147 is located in the acceleration section H. The open side buffer-portion area Ga is started from the acceleration section H and ended in an intermediate portion of the constant-speed section I. Along with an increase in the swing angle of the valve operating cam 52, the lift amount of the intake cam 153 reaches the maximum value in the speed conversion section J. Thereafter, the lift amount is reduced by the speed constant section K and the deceleration section L and becomes equal to "0" at the maximum retard angle position Scmax. The terminal end of the constant-speed section K is included in a closing side buffer-portion area Gb. The terminal end of the deceleration section L is located at the terminal end of the free running area F.

In the minimum valve operating characteristic Umin, a start point Hs of the corresponding acceleration section H is located at the start point of the free running area F. An increase in the lift amount of the intake cam 153 is started simultaneously with the free running area F. A terminal end Hf of the acceleration section H is located in a free running area F on the advance angle side of a maximum retard angle position Somin of opening timing. The acceleration of the lift speed of the intake cam 153 is ended in the free running area F. The constant-speed section I is started from the free running section F and the minimum retard angle position Somin corresponding to opening timing is located in the constant-speed section I. An opening side buffer-portion area Ga is started and ended in the constant-speed section I. Along with the increase in the swing angle of the valve operating cam 52, the lift amount of the intake cam 153 reaches the maximum value in the speed conversion section J. Thereafter, the lift amount is reduced by the constant-speed section K and the deceleration section L and becomes equal "0" at a maximum advance angle position Scmin. A terminal end of the constant-speed section K and a terminal end of the deceleration section L are located at a terminal end of the free running area F.

Figure 12:
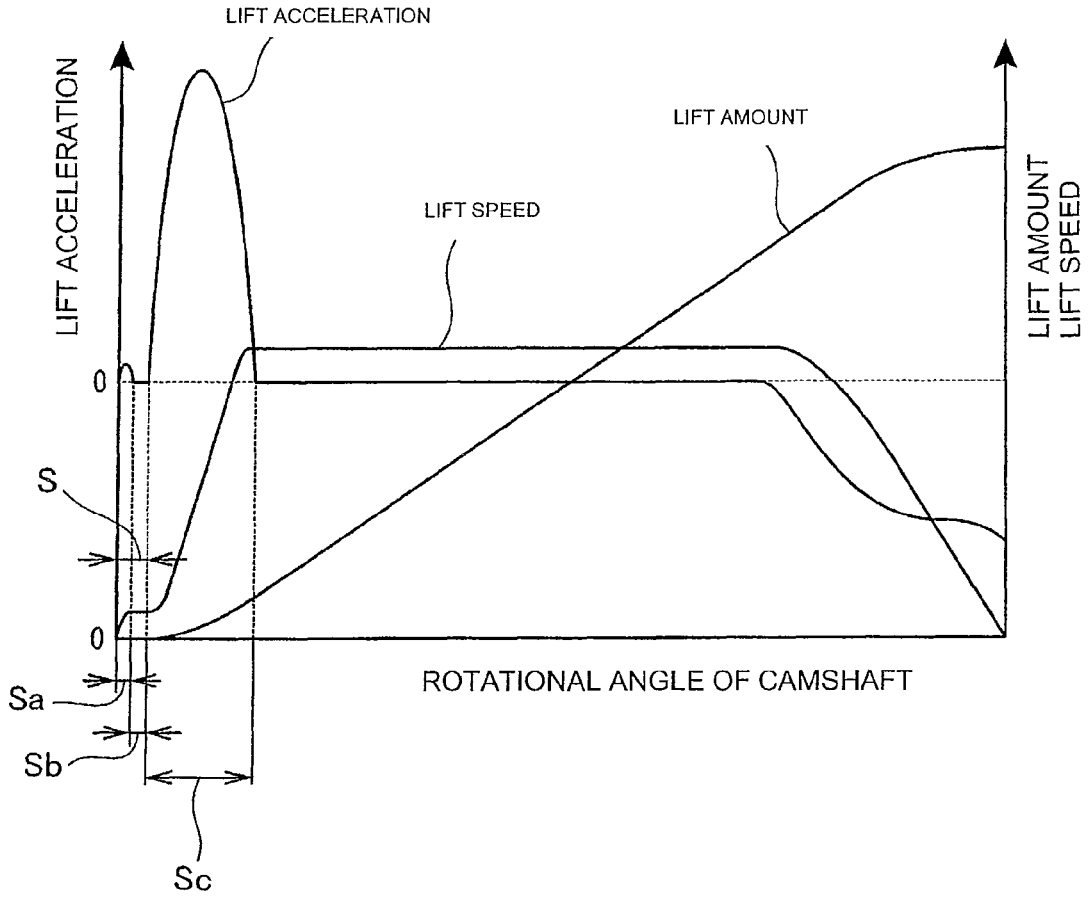
FIG. 12 is a graph showing operating characteristics of a traditional drive cam.

In the present embodiment, the intake cam 153 is provided with the acceleration section H in which the lift speed is increased directly from the base circular portion 153A of the intake cam 153 without the provision of the buffer transition section Sa and the buffer constant-speed section Sb (see FIG. 12). This can increase the length of the acceleration section H which is a section where the intake cam 153 accelerates the swing of the sub-rocker arm 54, according to without the provision of the buffer transition section Sa and the buffer constant-speed section Sb. Therefore, since the sub-rocker arm 54 can gently be accelerated, the elastic deformation of the sub-rocker arm 54 due to the application of large swing acceleration can be suppressed to stabilize the swing of the sub-rocker arm 54, which can stabilize the operating characteristics of the intake valve 147.

The constant-speed section I corresponding to the minimum valve operating characteristic Umin is provided to include the overall area of the opening side buffer-portion area Ga, from the advance angle side of the most retard angle position Somin of the opening position to an angle width including the most retard angle side of the opening side buffer-portion area Ga of the minimum valve operating characteristic Umin. More specifically, in the minimum valve operating characteristic Umin, the angle width X is provided between the start point of the speed constant section I and the most retard angle position Somin. Even if the buffer-portion area G is shifted toward the advance angle side along with the variation toward the maximum valve operating characteristic Umax, arbitrary opening timing of the opening side buffer-portion area Ga is included in the constant-speed section I, in the area where the shift amount does not exceed the angle width X. This opening timing means the start point of the opening operation of the intake valve 147 and thus means the most retard angle position Somin in the minimum valve operating characteristic Umin.

That is to say, the constant-speed section I is provided to extend over the angle width including at least the opening side buffer-portion area Ga of the minimum valve operating characteristic Umin located at the most retard angle side. As a result, even if the opening side buffer-portion area Ga may be shifted toward the advance angle side in accordance with the variation toward the maximum valve operating characteristic Umax, the lift speed of the intake cam 153 is maintained at the speed of the constant-speed section I in an area where such a shift amount does not exceed the angle width X. Therefore, in the minimum valve operating characteristic Umin and a major portion of an arbitrary valve operating characteristic on the advance angle side of the minimum valve operating characteristic Umin, the constant-speed section I having a constant lift speed can swing the valve operating cam 52 to open the intake valve 147. In other words, if the rotational speed of the camshaft 151 is the same, the valve operating cam 52 is swung at the same speed regardless of the vale operating characteristics. Therefore, when the valve clearance M becomes equal to "0" at the opening timing, the adjustment portion 51B of the rocker arm 51 comes into abutment against the upper end of the intake valve 147 at the same speed. Thus, it is possible to prevent the occurrence of a striking sound of the intake valve 147 caused by the valve clearance M along with the variation of the opening timing resulting from the variation in the valve operating characteristics.

In the maximum valve operating characteristic Umax, a maximum advance angle position Somax of opening timing is located in the corresponding acceleration section H and on the advance angle side of the constant-speed section I. Since the lift speed of the acceleration section H is almost the same as the speed of the constant-speed section I, the fact that the most advance angle position Somax is located on the advance angle side of the constant-speed section I virtually does not influence the occurrence of the striking sound of the intake valve 147.

Further, in the entire area from the minimum valve operating characteristic Umin to the maximum valve operating characteristic Umax, the free running area F may be expanded to expand the acceleration section H to a maximum until the start point Hs of the acceleration section H coincides with the terminal end of the deceleration section L. In this case, the length of the acceleration section H can largely be ensured so that the acceleration of swing applied to the sub-rocker arm 54 can be reduced.

At the point in time when the start point Hs is located at the free running area F and the acceleration of swing of the sub-rocker arm 54 by the intake cam 153 is started, the lift of the intake valve 147 is not started yet. Therefore, the variation of the lift acceleration of the intake cam 153 in the vicinity of the start point Hs does not influence the lift operation of the intake valve 147. Thus, the operating characteristic of the intake valve 147 can be stabilized.

In the maximum valve operating characteristic Umax, since the terminal end Hf of the acceleration section H is provided even in the opening side buffer-portion area Ga, the long acceleration section H can be ensured to reduce the acceleration applied to the sub-rocker arm 54. Further, the terminal end Hf is provided even in the opening side buffer-portion area Ga on the advance angle side of the lift area E where the lift amount of the intake valve largely increases. Therefore, even if the long acceleration section H is ensured in the maximum valve operating characteristic Umax, the lift acceleration in the acceleration section H does not largely influence the lift operation of the intake valve 147. Thus, the operating characteristics of the intake valve 147 can be stabilized. The state where the terminal end Hf of the acceleration section H is included in the opening side buffer-portion area Ga appears not only in the case of the maximum valve operating characteristic Umax but also in the case of an arbitrary valve characteristic encountered when the opening side buffer-portion area Ga is shifted to the retard angle side in the range of an angle width Y.

The curve line representing the lift amount of the cam lobe portion 153B is provided symmetrically with respect to the top T. Also in the valve-closing section, the intake cam 153 is provided with the deceleration section L formed similarly to the acceleration section H without the provision of the buffer transition section Sa and the buffer constant-speed section Sb. Therefore, the length of the deceleration section L can be increased according to without the provision of the buffer transition section Sa and the buffer constant-speed section Sb. Thus, even at the time of valve-closing, the acceleration applied to the sub-rocker arm 54 can be reduced to suppress the elastic deformation of the sub-rocker arm 54. This can stabilize the swing of the sub-rocker arm 54 to stabilize the operating characteristics of the intake valve 147.

Further in the maximum valve operating characteristic Umax, the start point of the deceleration section L is in the area of the closing side buffer-portion area Gb on the closing side of the valve-operating cam 52. After the lift amount of the intake valve 147 is largely reduced, the lift acceleration of the deceleration of the intake cam 153 is increased. Therefore, the behavior of the sub-rocker arm 54 resulting from the deceleration of the lift speed in the deceleration L does not largely influence the lift operation of the intake valve 147. Thus, the operating characteristics of the intake valve 147 can be stabilized.

In the entire area of the valve operating characteristic, the terminal end of the deceleration section L is in the free running area F not involving the lift of the intake valve 147. Therefore, the behavior of the sub-rocker arm 54 resulting from the deceleration of the lift speed of the intake cam 153 terminating at the terminal end of the deceleration section L does not influence the lift operation of the intake valve 147. Thus, the operating characteristics of the intake valve 147 can be stabilized.

As described above, according to the embodiment to which the invention is applied, the intake cam 153 is provided with the acceleration section H directly increasing the lift speed from the base circular portion 153A without the provision of the buffer transition section Sa and the buffer constant-speed section Sb. Therefore, the section where the intake cam 153 accelerates the swing of the sub-rocker arm 54 of the link mechanism 56 can be increased in length according to without the provision of the buffer transition section Sa and the buffer constant-speed section Sb. In this way, the swing of the sub-rocker arm 54 can gently be accelerated to suppress the elastic deformation of the sub-rocker arm 54 resulting from the application of the large swing acceleration. Thus, the swing of the sub-rocker arm 54 can be stabilized to stabilize the operating characteristics of the intake valve 147.

The constant-speed section I where the lift speed of the intake cam 153 is constant is provided to extend over the angle width including at least the most retard angle position Somin of the closing timing of the intake valve 147. Therefore, the lift speed of the intake cam 153 in the section on the advance angle side of the most retard angle position Somin can be made as the speed of the speed constant section I. In this way, the lift speed of the intake cam 153 corresponding to the most retard angle position Somin and to the opening timing on the advance angle side of the most retard angle position Somin can be made as the speed of the constant-speed section I regardless of the opening/closing timing. The swing speed of the valve operating cam 52 opening and closing the intake valve 147 can be made constant. Thus, it is possible to prevent the striking sound of the intake valve 147 resulting from the variation of the opening/closing timing.

The base circular portion 52A of the valve operating cam 52 is provided with the free running area F not involving the lift of the intake valve 147 and the free running area F is increased. Therefore, the length of the acceleration section H of the intake cam 153 can largely be ensured to reduce the acceleration applied to the sub-rocker arm 54. The acceleration of the lift of the intake cam 153 at the start point Hs of the of the acceleration section H does not influence the lift operation of the intake valve 147. Therefore, the operating characteristics of the intake valve 147 can be stabilized.

Further, the terminal end Hf of the acceleration section H is provided in front of or in the opening side buffer-portion area Ga of the valve operating cam 52 to ensure the long acceleration section H, thereby reducing the acceleration applied to the sub-rocker arm 54. Further, the terminal end Hf of the acceleration section H has almost the same speed as that of the constant-speed section I. As a result, even if the terminal end Hf of the acceleration section H may be provided in the opening side buffer-portion area Ga of the lift of the intake valve 147, there is no difference in the situations of the occurrence of the striking sound of the intake valve 147 between the most advance angle position Somax and the most retard angle position Somin. In addition, the operating characteristics of the intake valve 147 can be stabilized.

The intake valve 147 is opened and closed by the valve operating cam 52 swung at the same swing angle speed by the constant-speed section I. Therefore, the striking sound at the time of valve-opening can be reduced. In the maximum valve operating characteristic Umax, there is a portion where the opening side buffer-portion area Ga of the valve operating cam 52 is not present in the constant-speed section I. However, the variation in swing angle speed is not so much. Therefore, the acceleration section H can be increased to minimize the elastic deformation of the sub-rocker arm 54.

The free running area F is expanded to expand the acceleration section H to a maximum until the start point Hs of the acceleration section H coincides with the terminal end of the deceleration section L. Thus, the length of the acceleration section H can be maximized to minimize the elastic deformation of the sub-rocker arm 54.

In addition, the embodiment described above is an aspect applying the present invention thereto and the present invention is not limited to the embodiment described above.

The embodiment described above is explained as below. In the minimum valve operating characteristic Umin, the constant-speed section I is provided to include from the advance angle side of the most retard angle position Somin to an angle width including the most retard angle side of the opening side buffer-portion area Ga of the minimum valve operating characteristic Umin. However, the present invention is not limited to this. The constant-speed section I needs only to be provided to extend over the angle width including at least the most retard angle position Somin of the opening timing of the intake valve 147. For example, the constant-speed section I may not include the entire area of the opening side buffer-portion area Ga but include only the vicinity of the most retard angle position Somin. Further, the constant-speed section I may include the opening timing of the intake valve 147 in the entire area from the minimum valve operating characteristic Umin to the maximum valve operating characteristic Umax.

Although a detailed description is omitted in the embodiment described above, also the exhaust cam 154 is provided with the acceleration section H and the constant-speed section I similarly to the intake cam 153. Therefore, also the exhaust side valve train 50 can suppress the elastic deformation of the sub-rocker arm to stabilize the operating characteristic of the exhaust valve 148. In addition, it is possible to prevent the occurrence of a striking sound of the exhaust valve 148 resulting from the valve clearance M. Needless to say, the other detailed configurations of the motorcycle 10 can arbitrarily be modified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve train of an internal combustion engine, comprising:

a camshaft rotated in conjunction with a crankshaft of the internal combustion engine;

a valve operating cam pivotally supported by the camshaft for operatively opening and closing an engine valve as an intake valve or an exhaust valve;

a link mechanism for allowing a drive cam rotated integrally with the camshaft to swing the valve operating cam around the camshaft; and a drive mechanism for swinging the link mechanism around the camshaft;

wherein opening and closing of the engine valve are started in a buffer section of the valve operating cam, and opening/closing timing of the engine valve is controlled by the drive mechanism swinging the valve operating cam around the camshaft via the link mechanism; and wherein without a provision of a buffer transition section and a buffer constant-speed section encountered at the time of transiting from a base circle to a cam lobe of the drive cam, an acceleration section where lift speed of the drive cam is increased and a constant-speed section subsequent thereto where the lift speed of the drive cam is constant are provided in place of the buffer transition section and the buffer constant-speed section, and the constant-speed section is provided to extend over an angle width including at least a maximum retard angle position of opening timing of the engine valve.

2. The valve train of an internal combustion engine according to claim 1, wherein a start point of the acceleration section is in a free running area where lift of the engine valve is not involved although the valve-operating cam is swung, the free running area being provided on a base circle of the valve-operating cam.

3. The valve train of an internal combustion engine according to claim 1, wherein a terminal end of the acceleration section is located in front of or in a buffer-portion area of the valve-operating cam.

4. The valve train of an internal combustion engine according to claim 2, wherein a terminal end of the acceleration section is located in front of or in a buffer-portion area of the valve-operating cam.

5. The valve train of an internal combustion engine according to claim 3, wherein the terminal end of the acceleration section is in the buffer-portion area of the valve-operating cam in a maximum valve characteristic and is in front of the buffer-portion area of the valve-operating cam in a minimum valve characteristic and the buffer-portion area of the valve-operating cam is in an area of the constant-speed section.

6. The valve train of an internal combustion engine according to claim 4, wherein the terminal end of the acceleration section is in the buffer-portion area of the valve-operating cam in a maximum valve characteristic and is in front of the buffer-portion area of the valve-operating cam in a minimum valve characteristic and the buffer-portion area of the valve-operating cam is in an area of the constant-speed section.

7. The valve train of an internal combustion engine according to claim 1, wherein a deceleration section extending from a terminal end of the constant-speed section to the base circle of the drive cam is provided and the acceleration section is provided so that a start point of the acceleration section coincides with a terminal end of the deceleration section.

8. The valve train of an internal combustion engine according to claim 2, wherein a deceleration section extending from a terminal end of the constant-speed section to the base circle of the drive cam is provided and the acceleration section is provided so that a start point of the acceleration section coincides with a terminal end of the deceleration section.

9. The valve train of an internal combustion engine according to claim 3, wherein a deceleration section extending from a terminal end of the constant-speed section to the base circle of the drive cam is provided and the acceleration section is provided so that a start point of the acceleration section coincides with a terminal end of the deceleration section.

10. The valve train of an internal combustion engine according to claim 5, wherein a deceleration section extending from a terminal end of the constant-speed section to the base circle of the drive cam is provided and the acceleration section is provided so that a start point of the acceleration section coincides with a terminal end of the deceleration section.

11. A valve train of an internal combustion engine, comprising:

a camshaft rotated in conjunction with a crankshaft of the internal combustion engine;

a valve operating cam pivotally supported by the camshaft for operatively opening and closing an engine valve as an intake valve or an exhaust valve;

a link mechanism for allowing a drive cam rotated integrally with the camshaft to swing the valve operating cam around the camshaft; and a drive mechanism for swinging the link mechanism around the camshaft;

wherein opening and closing of the engine valve are started in a buffer section of the valve operating cam, and opening/closing timing of the engine valve is controlled by the drive mechanism swinging the valve operating cam around the camshaft via the link mechanism;

an acceleration section wherein lift speed of the drive cam is increased; and a constant-speed section subsequent to the acceleration section where the lift speed of the drive cam is constant;

said constant-speed section being provided to extend over an angle width including at least a maximum retard angle position of opening timing of the engine valve.

12. The valve train of an internal combustion engine according to claim 11, wherein a start point of the acceleration section is in a free running area where lift of the engine valve is not involved although the valve-operating cam is swung, the free running area being provided on a base circle of the valve-operating cam.

13. The valve train of an internal combustion engine according to claim 11, wherein a terminal end of the acceleration section is located in front of or in a buffer-portion area of the valve-operating cam.

14. The valve train of an internal combustion engine according to claim 12, wherein a terminal end of the acceleration section is located in front of or in a buffer-portion area of the valve-operating cam.

15. The valve train of an internal combustion engine according to claim 13, wherein the terminal end of the acceleration section is in the buffer-portion area of the valve-operating cam in a maximum valve characteristic and is in front of the buffer-portion area of the valve-operating cam in a minimum valve characteristic and the buffer-portion area of the valve-operating cam is in an area of the constant-speed section.

16. The valve train of an internal combustion engine according to claim 14, wherein the terminal end of the acceleration section is in the buffer-portion area of the valve-operating cam in a maximum valve characteristic and is in front of the buffer-portion area of the valve-operating cam in a minimum valve characteristic and the buffer-portion area of the valve-operating cam is in an area of the constant-speed section.

17. The valve train of an internal combustion engine according to claim 11, wherein a deceleration section extending from a terminal end of the constant-speed section to a base circle of the drive cam is provided and the acceleration section is provided so that a start point of the acceleration section coincides with a terminal end of the deceleration section.

18. The valve train of an internal combustion engine according to claim 12, wherein a deceleration section extending from a terminal end of the constant-speed section to a base circle of the drive cam is provided and the acceleration section is provided so that a start point of the acceleration section coincides with a terminal end of the deceleration section.

19. The valve train of an internal combustion engine according to claim 13, wherein a deceleration section extending from a terminal end of the constant-speed section to a base circle of the drive cam is provided and the acceleration section is provided so that a start point of the acceleration section coincides with a terminal end of the deceleration section.

20. The valve train of an internal combustion engine according to claim 15, wherein a deceleration section extending from a terminal end of the constant-speed section to a base circle of the drive cam is provided and the acceleration section is provided so that a start point of the acceleration section coincides with a terminal end of the deceleration section.

* * * * *